United States Patent [19]

Thurston

[11] Patent Number: 4,457,248

[45] **Date of Patent: * Jul. 3, 1984**

[54] MULTIHULL VESSELS

[76] Inventor: John W. Thurston, P.O. Box 724, Alexandria, Va. 22313

[ * ] Notice: The portion of the term of this patent subsequent to Jun. 26, 1996 has been disclaimed.

[21] Appl. No.: 162,908

[22] Filed: Jun. 25, 1980

[51] Int. Cl.[3] ..... B63B 43/14

[52] U.S. Cl. ..... 114/39; 114/123; 114/91

[58] Field of Search ..... 114/284, 283, 143, 123, 114/91, 90, 61, 39

[56] References Cited

U.S. PATENT DOCUMENTS

| | | | |
|---|---|---|---|
| 1,710,625 | 4/1929 | Kapigian | 114/123 |
| 3,068,830 | 12/1962 | Dickerson | 114/123 |
| 3,485,198 | 12/1969 | Matthews | 114/123 |
| 3,541,987 | 11/1970 | Barkley | 114/61 |
| 3,954,077 | 5/1976 | Piat-Marchand | 114/123 |
| 3,981,259 | 9/1976 | Harper | 114/123 |
| 4,159,006 | 6/1979 | Thurston | 114/39 |

*Primary Examiner*—Galen Barefoot
*Assistant Examiner*—Stephen P. Avila
*Attorney, Agent, or Firm*—Burns, Doane, Swecker & Mathis

[57] ABSTRACT

A multihull vessel has a center section; a pair of floats displaceable from normal operative positions laterally extended on either side of the center section upwardly to positions above the center section and inwardly toward the center axis of the vessel as well as downwardly toward any hull or sides of the center section and inwardly to positions below any superstructure of the center section; arms consisting of pivotally mounted and jointed members connecting the floats to the center section and capable of positioning and maintaining the floats at positions between fully raised and fully lowered; one or more masts displaceable from a fully vertical position to a fully prone position; elements of standing rigging of effectively adjustable length between mast and center section or floats and apparatus for adjusting singly or in coordination, even while underway, docked or capsized, with inboard, in place and centrally located control devices, any of the floats or masts to any allowable orientation with respect to the center section. Operations possible with such a vessel include: unaided righting of the capsized vessel, reducing the beam to that of the center section for trailering or accommodating a narrower berth or passage, lowering the mast for stowage or for accommodating a berth or passage of restricted height, and changing the relative positions of aforementioned elements of structure or rigging for improvements in performance, safety or comfort in various sailing attitudes.

11 Claims, 30 Drawing Figures

FIG. 23
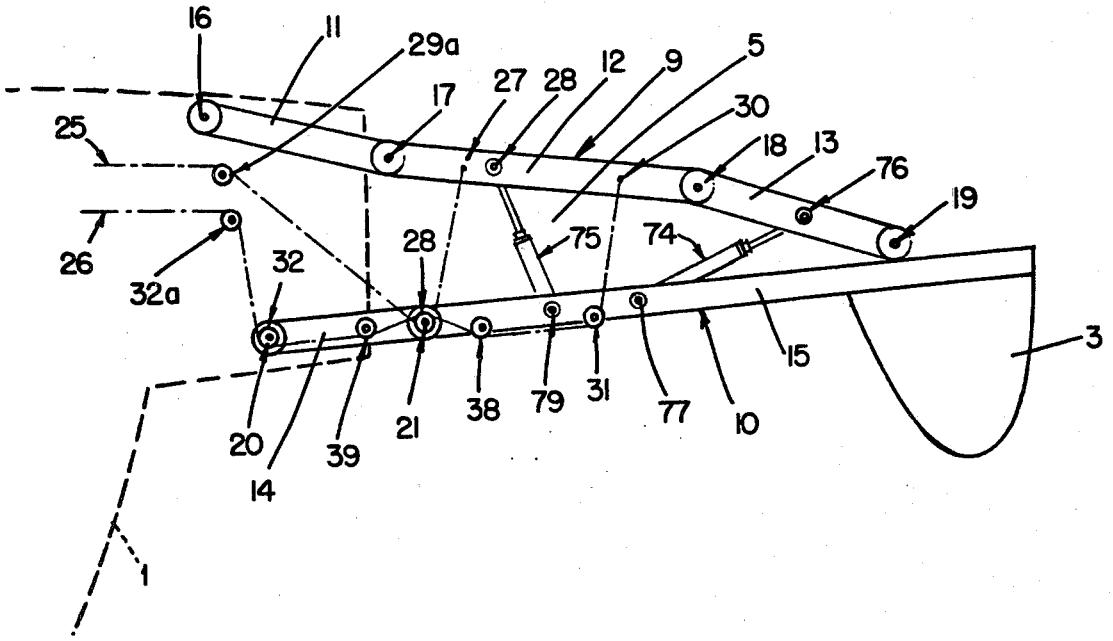
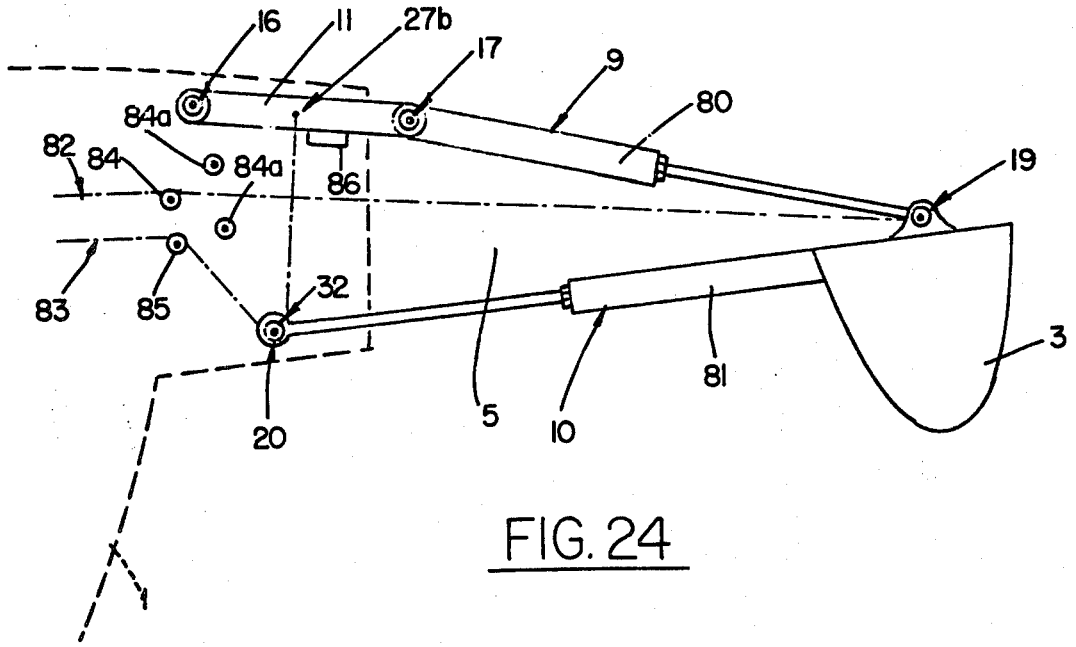
FIG. 24

MULTIHULL VESSELS

BACKGROUND OF THE INVENTION

This invention relates to multihull vessels having a central section, which may be a cabin or other superstructure with or without an attached hull, and a pair of hulls or floats (hereinafter referred to as floats) oppositely spaced from the center section on pivotally mounted and joined arms or outriggers (hereinafter referred to as float arms).

In contrast to a self-righting monohull vessel which maintains stability by having its center of gravity arranged below its center of buoyancy, a multihull vessel provides buoyancy to oppose heeling in the form of divided hulls or outrigger floats. A monohull sailboat with ballasted keel has no righting moment at 0 degrees of heel where heeling moment is maximum, has maximum righting moment at 90 degrees of heel where heeling moment on the sailplan vanishes and is unstable at 180 degrees of heel. A multihull vessel has large initial stiffness or resistance to heeling due to the lateral displacement of the center of buoyancy, but the righting moment decreases as the angle of heel increases and as more of the bottom of the vessel is exposed to the forces of wind and waves and the vessel is more stable at 180 degrees of heel than at 0 degrees unless additional buoyancy is provided above the center of gravity of the upright vessel. Unless the beam of the vessel can be reduced, a very large righting moment is required, usually in the form of often unavailable external leverage, to bring the vessel back past 90 degrees of heel.

Flooding of one float is often proposed to negate the stabilizing effect of its buoyancy in the capsized position, but the disadvantages of this method are obvious, both in its performance and in subsequent recovery in a situation of continued duress. Various schemes exist to use topside buoyancy in the form of of an enlarged watertight cabin, in the form of masthead flotation or in various other forms of fixed or inflatable buoyancy on or above deck. Several applications are known in which the floats are retracted or folded to the sides of or under the center section to reduce the beam, but such methods are usually only for such purposes as preparing the vessel for trailering or for a narrower berth. Such methods cannot usually be performed with any ease while underway and external leverage is still usually required for capsize recovery. At least a couple of applications have been proposed in which the floats can be pivoted upward agaist resistance provided by resilient means to allow heeling of the center section for the primary purpose of preventing capsize. Such methods make no provision for moving the floats sufficiently inboard to make a fully capsized vessel unstable and do not provide adequate means to lift the center section of such a vessel out of or sufficiently higher in the water by such positioning of the floats.

It is believed that all of the prior art adjustable float multihull vessels are wholly dependent on concepts absent from the present invention which limit their range of applications to very few of the potential improvements in performance, safety and comfort possible as secondary benefits of the present invention. These prior art multihull vessels require float adjustability which is either too resilient or which can only assume a few rigidly supported positions, which must either be automatically actuated or which cannot be sufficiently expeditiously effected and which do not have the range and types of adjustability nor the flexibility of interaction with other rigging elements to achieve more than a few capabilities of the present invention. It is an object of the present invention to provide means for varying the positions of floats from their normal extended positions, laterally spaced from the center section to provide stability in normal sailing attitudes, to positions raised above the center section, i.e., beneath the center section when the vessel is fully capsized (the term "beneath" being used here in relation to the capsized vessel), which would render the vessel unstable in an inverted or capsized attitude, and also to positions lowered to the sides of or below the center section of the upright vessel, which would reduce the beam for various purposes such as trailering or accommodating a narrower berth.

It is another object of the invention to provide means for adjusting the floats to and maintaining them in various orientations with respect to the center section at all heights between the fully raised and the fully lowered positions, which means are contained inboard and in-place as permanent components of the structure and rigging, require no equipment to be attached to or detached from the floats or arms to effect the adjustments and require no releasable restraints and a minimum of fixed limits on the rotation around joints within the float arms. Applications in addition to those alluded to above for reducing the beam in the extreme positions include alterations in float height, distance from the center hull and attitude for fine adjustments to the vessel's performance in different operational circumstances and for more fundamental adjustments of the vessel's performance characteristics such as lifting the main hull of a trimaran nearly clear of the water to gain any performance advantages of a catamaran or rotating the floats to bring planing or hydrofoil surfaces into operational positions.

It is a further object of the invention to make elements of the standing rigging adjustable such that the position of a mast may be varied from fully vertical to fully horizontal (possibly in either the fore or aft directions) and such that adjustments of the mast can be carried out in a variety of ways, independently of or in conjunction with adjustments of the floats. Beside independent lowering of the mast for stowage and raising of the mast from the stowed position, the applications include lowering the mast as the floats are raised in a capsize recovery for the purpose of pivoting shrouds out of the way of the floats; lowering the mast to the deck in a capsize recovery for the purpose of utilizing shrouds to lift the floats, with motive force possibly being supplied by masthead flotation; causing the mast to be re-raised during capsize recovery by the re-lowering of the floats and leaving the mast stowed on the deck as floats are re-lowered during capsize recovery, with raising and lowering referred to the vessel in its upright position.

It is a further object of the invention to bring control of rigging or other equipment which effects and maintains the adjustment of floats and mast to a central location where this control can be readily and selectably exercised in a variety of combinations of possible operations by the crew while underway or even while capsized.

It should be noted that in all of the following description terms such as "up" and "down" or "raising" and "lowering" will be assumed to be defined in terms of the upright vessel, unless otherwise noted, even when it is being considered to be upside down in the water.

SUMMARY OF THE INVENTION

According to the present invention, there is provided a multihull vessel comprising a center section, which may be a cabin, platform or other superstructure with or without an attached center hull; a pair of floats oppositely spaced from the center section; a plurality of float arms consisting of segments, arranged in fore and aft float arm assemblies for each float and pivotally connected at their ends to the center section, to the floats or to other float arm segments; rigging lines connecting float arm segments which are fixedly attached at one end within the float arm assemblies and which are led via pulleys or other guides within the float arm assemblies and the center section to means for controlling this rigging from a central location; at least one mast, normally connected pivotally to the center section; elements of standing rigging which can be effectively adjusted in length by leading the termination of this rigging or, optionally, of additional rigging, attached to or riding via pulleys on the standing rigging for the purposes of collapsing triangles formed by the standing rigging and a mast, to means for controlling this rigging from a central location within the center section and finally, controls in a central location which can be used to independently or simultaneously in various selectable combinations adjust the length of rigging which can vary the positions of either or both floats and the mast by any desired amount from those which may be described as fully raised to those which may be described as fully lowered.

A particular embodiment of the invention is a sailing trimaran (having a central hull) with float arm arm assemblies jointed twice in upper arms and pivoting at either end and jointed once in lower arms and pivoting at the inboard ends and with a single mast pivoting near the deck. This embodiment will now be described, by way of an example, along with various alternative or optional features and extensions of the basic structure, with reference to the accompanying drawings, wherein:

BRIEF DESCRIPTION OF THE DRAWINGS

FIG. 23 is a cross-sectional view of one float arm assembly with hydraulic pistons disposed between float arms for controlling the positions of the float;

FIG. 24 is a cross-sectional view of one float arm assembly with hydraulic pistons replacing sections of float arms for controlling the positions of the float;

DESCRIPTION OF THE PREFERRED EMBODIMENTS

Figure 1:
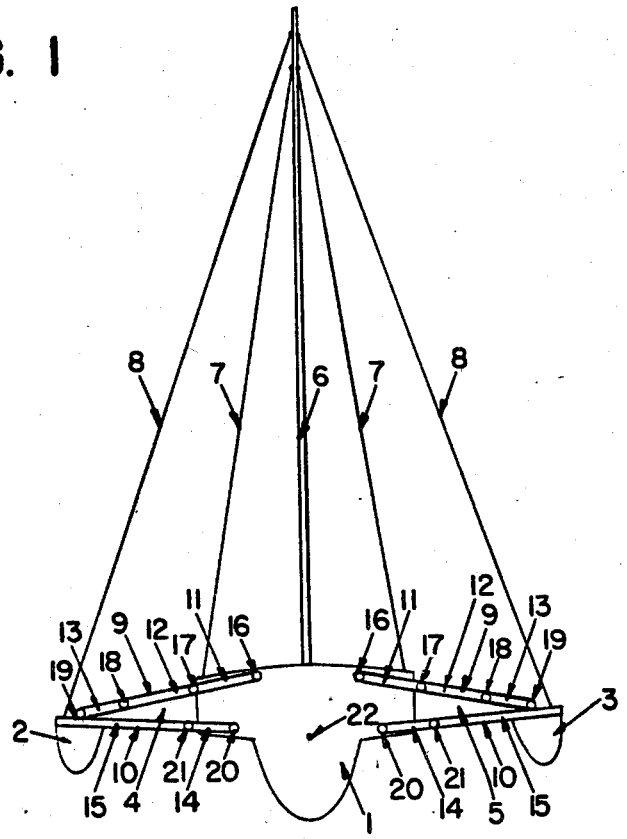
FIG. 1 is a cross-sectional view of a trimaran according to the invention at the ordinate of either the fore or aft float arm assemblies with the floats in the normal extended positions.

The embodiments of the invention illustrated and described below all relate to but are not limited to sailing trimarans and FIG. 1 shows in cross-sectional outline a trimaran according to the invention with floats extended in normal sailing positions. The vessel comprises a center section or center hull 1 to which floats 2 and 3 are attached by float arm assemblies 4 and 5, a mast 6, center hull shrouds 7 between the mast and center hull and float shrouds 8 between the mast and floats. The mast 6 and shrouds 7 and 8 may be broadly described as comprising part of a standing rigging which may also include conventional stays, etc. The upper float arms 9 and the lower float arms 10 consist of float arm segments 11, 12 and 13 for the upper arms 9 and of float arm segments 14 and 15 for the lower arms 10, respectively. Segments 11, 12 and 13 of the upper arms 9 are pivotally connected to the center hull 1, internally in two joints and at the floats 3 and 4 at pivots 16, 17, 18 and 19. Segments 14 and 15 of the lower arms 10 are pivotally connected to the centerl hull 1 and to each other at pivots 20 and 21 and fixedly at floats 2 and 3. All pivots 16, 17, 18, 19, 20 and 21 are oriented with axes substantially horizontal in a fore and aft direction. The segments and pivots are recited in order of increasing distance from the vessel's longitudinal axis through the center of gravity 22 and may be referred to unambiguously with such names as upper float arm middle arm segment 12 and upper arm inboard internal pivot 17, for example.

The float arm geometry illustrated in FIG. 1 is one embodiment or configuration of outriggers which has the capability of being used both to raise and to lower the floats through a range of desired heights and lateral distances from the center hull. In the laterally extended position for this double arm configuration both the upper arms 9 and the lower arms 10 are understood to be substantially straight.

As noted earlier, in all of the following description, terms implying direction relative to the vertical such as "up" and "down" or "raising" and "lowering" will be assumed to be defined in terms of the upright vessel, unless otherwise noted, even when reference is being made to a vessel upside-down in the water.

Figure 2:
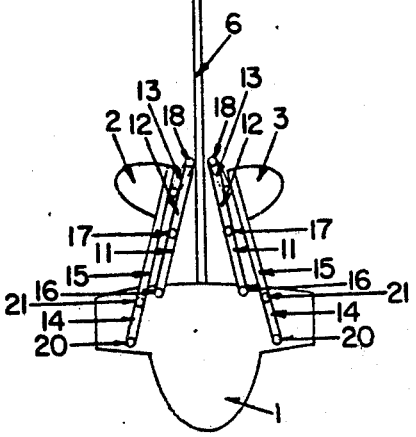
FIG. 2 is a cross-sectional view similar to FIG. 1 but with the floats raised upwardly and inwardly over the deck.

FIG. 2 illustrates in cross-sectional outline the relative positions of the float arm segments 11, 12, 13, 14 and 15 when the floats 2 and 3 have been pivotally raised near to their extreme positions over the middle of the center hull 1 against the mast 6. The only internal float arm pivots required for raising floats 2 and 3 in this manner are the upper arm outboard internal pivots 18. The shrouds 7 and 8 have been left out of this illustration.

Figure 3:
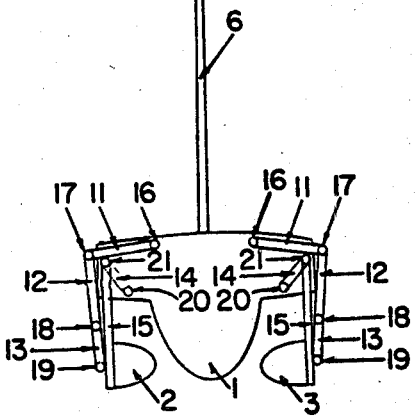
FIG. 3 is a cross-sectional view similar to FIG. 1 but with the floats lowered under the deck superstructure and inwardly to the sides of the center hull.

FIG. 3 illustrates in cross-sectional outline the relative positions of float arm segments 11, 12, 13, 14 and 15 when the floats 2 and 3 have been pivotally lowered toward the sides of the center hull 1 with the outboard float arm segments 12, 13 and 15 in substantially vertical orientation. Upper arm outboard float arm pivots 18 are not required for lowering the floats 2 and 3 in this manner. The shrouds 7 and 8 are not shown in this illustration.

Figure 4:
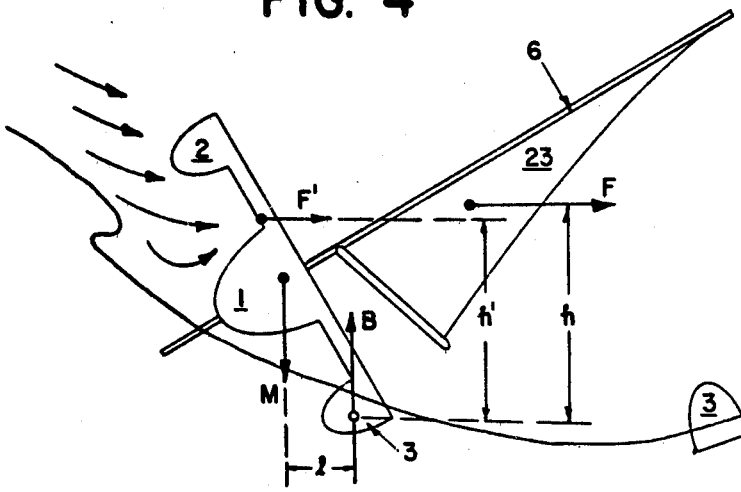
FIG. 4 shows in cross-sectional outline, except for the representation of the mainsail, a trimaran with fixed extended floats at a high degree of heel.

FIG. 4 shows in cross-sectional outline, except for the representation of the mainsail, a trimaran with fully extended floats 2 and 3 at a high angle of heel caused by the force of the wind on the mainsail 23 and the center hull 1. The wind is represented by force vectors F and F′ on these respective centers at respective heights h and h′ above the shifted center of buoyancy. The resultant wind forces F and F′ are proportional to the effective vertical projections of the exposed areas of sailplan and undersurface, respectively. The gravity force vector M and the buoyant force vector B, applied at the respective centers of gravity and buoyancy, are displaced laterally from each other by the moment arm for righting l and are equal in magnitude at equilibrium. As the angle of heel increases beyond that angle at which only the windward float 2 comes out of the water, the displacement l decreases and the effective vertical projection of sail area decreases. If the strength of the wind increases sufficiently, the heeling moment $Fh+F'h'$ will exceed the righting moment M and the heeling moment will increase further as the angle of heel increases to 90 degrees and the righting moment decreases to zero. If the center of gravity becomes displaced to the leeward side of the center of buoyancy, the vessel will heel further by itself and will not reach a stable equilibrium again until it has capsized to 180 degrees of heel.

Figure 5:
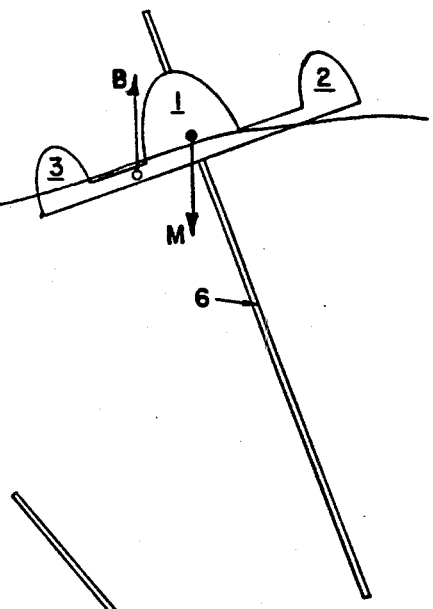
FIG. 5 shows in cross-sectional outline, a capsized trimaran with fixed or extended floats.

FIG. 5 shows in cross-sectional outline a trimaran with floats extended in the fully capsized position and illustrates that the vessel is intrinsically more stable upside down than right-side up.

Figure 6:
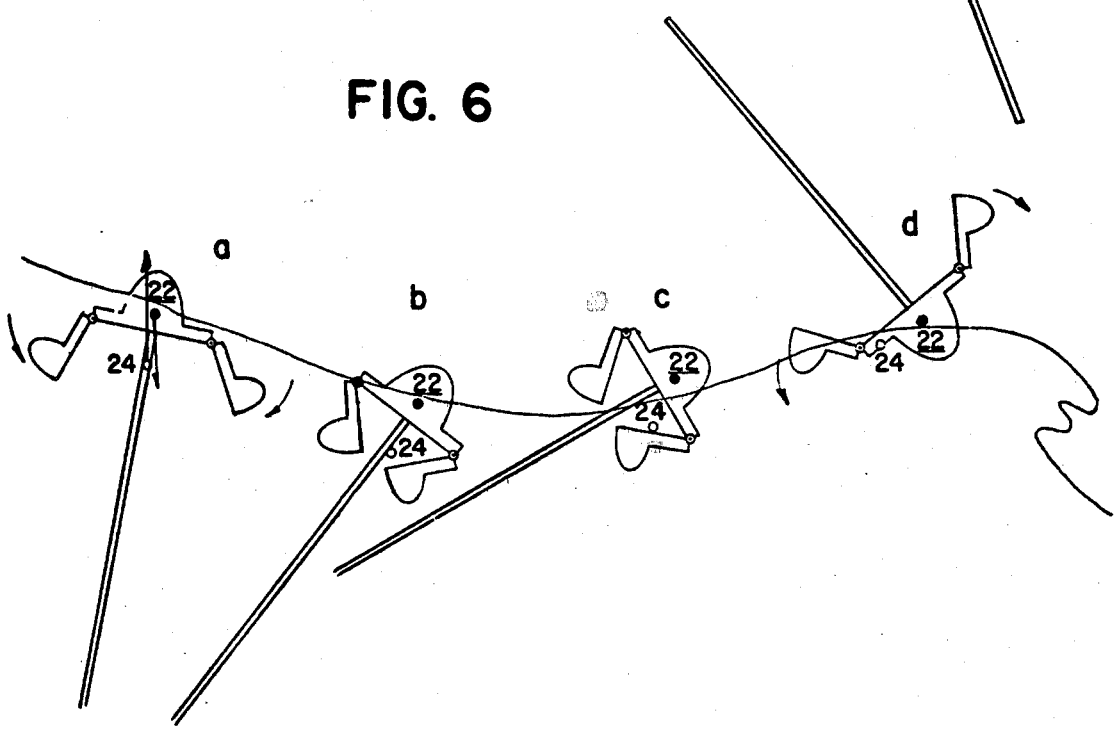
FIG. 6 shows in cross-sectional outline of a simplified representation of a trimaran with floats folded above the deck a sequence of stages in the righting of the capsized vessel.

FIG. 6 shows in cross-sectional outline of a simplified representation of a trimaran sith floats 2 and 3 folded above the deck a sequence of stages in the righting of the capsized vessel. In the figure the center of gravity or mass 22 is represented by a solid dot • and the center of buoyancy 24 is represented by an open dot o. In the first stage of recovery the floats 2 and 3 are being "raised" above the deck of the center hull 1 thus placing the center of buoyancy 24 lower in the water than the center of gravity 22 of the capsized vessel. The situation shown with unbalanced forces of gravity M and buoyancy B could only occur if the floats 2 and 3 are placed above the deck faster than the vessel can be lifted in the water (against viscous drag on the standing rigging and the sailplan) to make the volume of water displaced decrease until its weight equals that of the vessel. The righting sequence is possible with floats 2 and 3 of substantially less total buoyancy than the center hull 1 as long as the center of buoyancy 24 can be positioned lower in the water than the center of gravity 22 of the capsized vessel.

In the second stage of recovery the center of gravity 22 is shifting away from the center of buoyancy 24 in the direction of roll, even though the center of buoyancy 24 is also shifting in that direction, as the vessel rolls away from the fully inverted position in which the center of gravity 22 was directly above the center of buoyancy 24. Little or no external leverage will be required to continue this roll away from an upside-down position of unstable equilibrium if the floats are fully submerged in this position. The closer that the floats 2 and 3 can be positioned toward the center of the vessel and the mast 6, if the floats are too buoyant to be fully submerged, the less external leverage would be required from the action of wind and waves to push the center of gravity 22 outboard of the separate centers of buoyancy of the floats 2 and 3 in the metastable equilibrium which would result from the center hull 1 being lifted completely out of the water. Furthermore, the higher the center hull 1 can be lifted out of the water, the more leverage can be supplied by wind and waves to roll the vessel past the region of metastable equilibrium.

In the third stage of capsize recovery the vessel is continuing its roll towards another metastable equilibrium on its side. The vessel could be left in this position for some time after capsize recovery since a relatively small vertical area is exposed to the wind. A very strong gust of wind might flip the vessel to the similar position on its leeward side where it would likely remain until fully righted. In the final stage of recovery the vessel is brought to the fully righted position merely by bringing the floats 2 and 3 back to their laterally extended positions.

It will be noted that little or no buoyancy is required for the center section, which need not even be a hull, in order for this method to be implemented.

Figure 7:
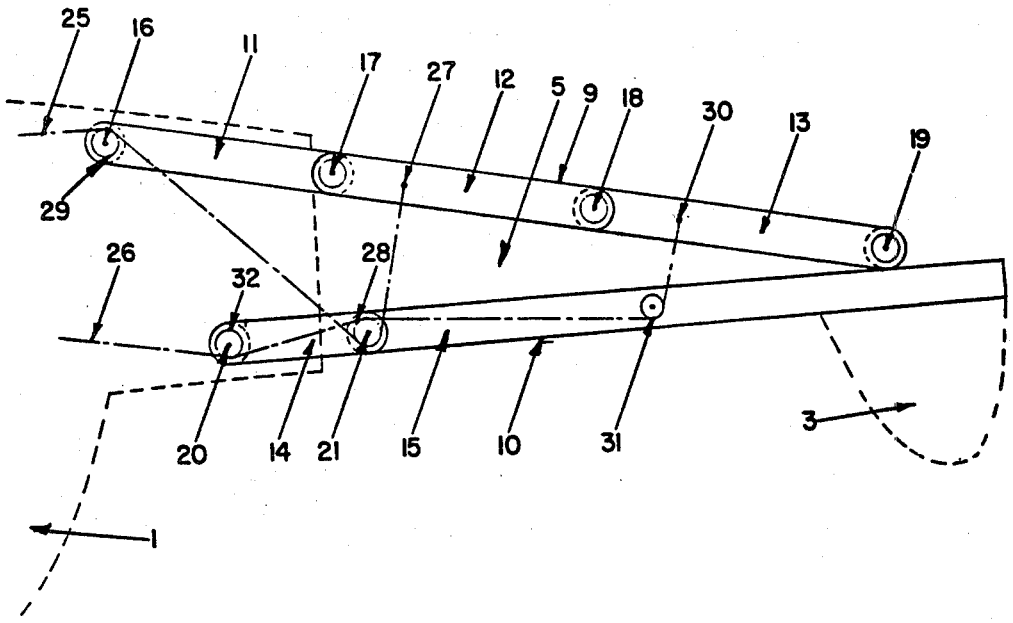
FIG. 7 is a cross-sectional view of one float arm assembly and internal rigging for controlling the positions of the float.

FIG. 7 is a cross-sectional view of one float arm assembly 5—either the fore or aft assembly—illustrating the simplest configuration of rigging which could be used with the float arm geometry shown in FIG. 1 to maintain the height of the float 3 at any position between the extremes represented in FIG. 2 and FIG. 3. Two types of float arm control rigging, float fold-down rigging 25 and float return-down rigging 26, are used to maintain all three internal joints under balanced opposing forces, both types of rigging terminating at points within the float arm assembly 5, spanning the space between the float arms 9 and 10 in one or more places and being led through pulleys or around shafts or sleeves to the center hull. In the illustrated embodiment the float fold-down rigging line 25 terminates at a point of connection 27 in the upper float arm 9 inboard or outboard of inboard internal pivot 17, is led around a tension directing pulley or sleeve 28 concentric with the lower arm internal pivot 21 and thence around a tension directing pulley or sleeve 29 concentric with the inboard upper arm end pivot 16 and is brought inboard to suitable means for controlling its length. In a similar fashion the float return-down rigging line 26 terminates at a point of connection 30 in the upper float arm 9, is led around a tension directing pulley or sleeve 31 in the outboard lower float arm segment 15 and thence over tension directing pulley or sleeve 28 concentric with the lower arm internal pulley or sleeve 32 concentric with the lower arm inboard pivot 20 to suitable means for controlling its length.

The float fold-down rigging line 25 is shortened to lower the float 3 toward the hull 1 by causing upward buckling of lower float arm 10 around internal pivot 21. This rigging is principally used to control the height of the float 3 below the normal laterally extended position. The float return-down rigging line 26 will require minimal adjustment in length for changes in height of float 3 below its laterally extended position if the point of connection 30 is situated appropriately for the given float arm geometry. The float return-down rigging line 26 is lengthened to permit upward buckling of upper float arm 9 around outboard internal pivot 18 when the float 3 is raised above the deck of the center hull 1. Rigging line 26 is shortened to lower the float again to its normal laterally extended position. This rigging is used principally to control the height of the float 3 above its laterally extended position while the float fold-down rigging will require minimal adjustment in length for changes in the height of float 3 above its laterally extended position if the point of connection 27 is situated appropriately for the given float arm geometry. The float control rigging line not principally adjusted in the two instances of float height adjustment above and below the lateral position, respectively, can be adjusted for secondary corrections to the angles between float arm segments at the pivots not involved in each instance. The simple embodiment of these two types of float arm control rigging, 25 and 26, probably cannot be designed to provide sufficient leverage, however, to raise the float 3, at least above the laterally extended position, and some other means must be provided to lift the floats in operational circumstances. Additional optional rigging internal to the float arm configuration 5 could be designed to raise the float 3 from a position below the laterally extended position as well as from the laterally extended position, but the preferred embodiment of the invention will employ rigging for raising the floats which is part of the float shroud 8 and which will be described below.

While insufficient upward force is being maintained on the float 3 either by the float shroud 8 or by the buoyant force of the water, this simple arrangement of float-arm control rigging lines 25 and 26 can maintain the integrity of the float arm configuration 5 at any desired float height with the desired angles between the float arm segments at internal pivots 17, 18 and 21 and with no other constraint on the arc through which any pivot can rotate other than not allowing the inner upper arm segment 11 to swing any lower than its designed orientation in the laterally extended position of the float arm assembly 5. If back-buckling of upper arm pivot 18 against the lower arm segment 15 is to be avoided, pivot 18 could be prevented from forming a line with pivots 17 and 19 except in the fully folded-down position of the float 3 by physically restricting arm segment 13 from rotating conter-clockwise at pivot 18 above the line formed with arm segment 12 or, alternatively, by locating the foot of the adjustable float shroud 8 on one of the outboard float arm segments 12 or 13.

If the inboard internal upper arm pivots 17 and the internal lower arm pivots 21 are not provided, the floats 2 and 3 cannot be lowered below their extended position and the float fold-down rigging line 25 would not be required. The same rigging could, however, be used for lifting the floats if these pivots are either not provided or the arm segments are temporarily physically restrained from rotating around these pivots. Point of connection 27 would be situated so that a shortening of (fold-down) rigging line 25 would cause lower arm 10 to rotate upward as (return-down) rigging line 26 is being relaxed. Rigging line 25 would of course have to be relaxed to permit re-lowering of the float 3 in this case. Similarly, if pivots 18 are not provided, the floats 2 and 3 cannot be raised far above the extended position and the float return-down rigging line 26 would not be required. The same rigging could be used in this instance, however, to re-raise the folded floats 2 and 3 back to the laterally extended position. Point of connection 30 would be situated so that a shortening of (return-down) rigging line 26 would cause lower arm 10 to return to a substantially straight orientation simultaneously with a relaxation of (fold-down) rigging line 25. Rigging line 26 would of course have to be relaxed in this case to permit the lowering of the float 3 below its laterally extended position.

Figure 8:
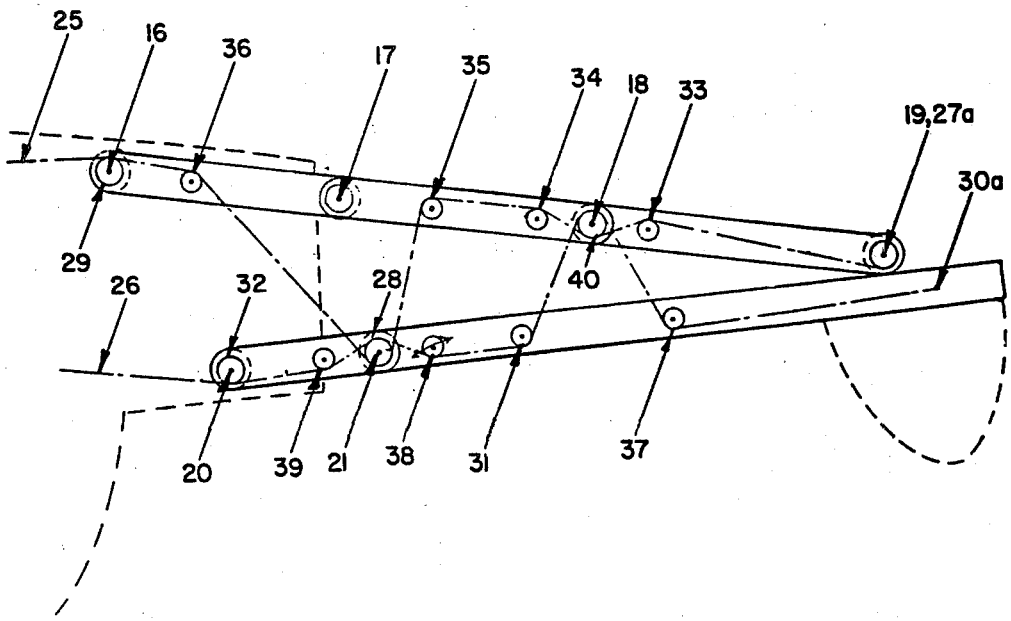
FIG. 8 is a cross-sectional view of one float arm assembly and another embodiment of the internal rigging for controlling the positions of the float.

Referring now to FIG. 8 auxiliary tension directing pulleys 33, 34, 35, 36, 37, 38 and 39 may be introduced along the lengths of the various float arm segments 11, 12, 13, 14 and 15 in addition to the single such pulley 31 in FIG. 7. Tension directing pulley or sleeve 40 may be introduced concentric with the upper arm outer internal pivot 18 in addition to those in FIG. 7 concentric with pivots 16, 20 and 21. The points of connection 27 and 30 of FIG. 7 may be moved to any points **27*a* and 30*a* outboard of all the tension directing pulleys. In the embodiment illustrated in FIG. 8 the float fold-down rigging line 25 is led from the terminal point 27*a* in the upper arm over pulley 33, under pulley or sleeve 40 at upper arm outer internal pivot 18, over pulleys 34 and 35 in the internal upper arm segment 12, under pulley or sleeve 28 at lower arm internal pivot 21, over pulley 36 in upper arm segment 11 and over pulley 29 at upper arm inboard pivot 16 to suitable means for controlling its length. Similarly float return-down rigging line 26 is led from terminal point 30*a* in the lower float arm under pulley 37 in the lower arm outboard segment 15, over pulley or sleeve 40 at pivot 18 in the upper arm, under pulleys 31 and 38 in lower arm outboard segment 15, over pulley or sleeve 28 at lower arm internal pivot 21, under pulley 39 in the lower arm inboard segment 14 and under pulley or sleeve 32 at lower arm inboard pivot 20** to suitable means for controlling its length.

Tension directing pulleys 33 and 34 on either side of pulley or sleeve 40 at pivot 18 and tension directing pulleys 38 and 39 on either side of pulley or sleeve 28 at pivot 21 can be used to increase the opposing perpendicular forces at these joints. The positions of all of the auxiliary tension directing pulleys 31 and 33 through 39 can be calculated according to known methods of analysis for the designed float arm geometry or can be experimentally adjusted to provide a balance of forces at all internal float arm pivots 17, 18 and 21 which will maintain the desired relative orientations of all float arm segments 11 through 15 within close limits throughout the range of float heights. Furthermore, the float 3 can be raised with force which can be applied with the float arm control rigging lines 25 and 26 at the internal pivots 17, 18 and 21 without additional rigging (internal or external to the float arm configuration 5) when some or all of these auxiliary tension directing devices are properly located. The physical constraint on rotation of the inner upper arm segment 11 may even be removed by positioning either auxiliary pulley 35 or 36 on the opposite side of upper arm inner internal pivot 17 from that at which it is depicted in FIG. 8.

The optimum positioning of auxiliary tension directing pulleys 33 through 39 will minimize the amount of tension required on each of the two rigging lines 25 and 26 to maintain the float 3 at any desired position. It will also minimize the amount the secondary line (25 or 26) must be adjusted to fine-tune the angles between the arm segments at internal joints 17, 18 and 21 after a larger adjustment of the primary line (26 or 25) is made to change float height above and below the laterally extended position, respectively, as described above for the configuration in FIG. 7. It will further minimize the amount that joints 16 through 21 will "work" or flex to readjust to varying forces on the float 3. In practice not all of the auxiliary pulleys 33 through 39 might prove necessary to satisfy all the foregoing requirements within acceptable limits. Some adjustment of the secondary rigging control line involved in each type of float adjustment will normally be required with the configuration of FIG. 8. Normally a loosening of the secondary line will be required to permit the action effected by tightening the primary line.

In principle, float shrouds 8 would not be required for the configuration of float arm rigging in FIG. 8 either to maintain the integrity of the float arm assembly 5 at a given float height or to assist in the raising of the float 3 as mentioned for FIG. 7 and described below. Float shrouds, if used, would have to be lengthened or repositioned in some way to allow lowering of the floats below the laterally extended positions. Without the float shroud 8 under tension to stiffen the disposition of float arm assembly 5, the joints 16 through 21 should flex or "work" slightly to readjust the angles between arm segments 11 through 15 in response to varying buoyant forces on the float 3. This flexibility of the float arm assembly 5 could be exploited as a load equalizer or shock absorber to produce a more comfortable, even safer ride in choppy seas. It should be noted that if the float shroud 8 is held under tension, the tension will decrease as the buoyant forces are increased and an almost constant upward force on the float and, therefore, a fixed set of angles between the float arm segments 11 through 15 will be maintained up to the point at which the buoyant forces equal the original float shroud tension.

Figure 9:
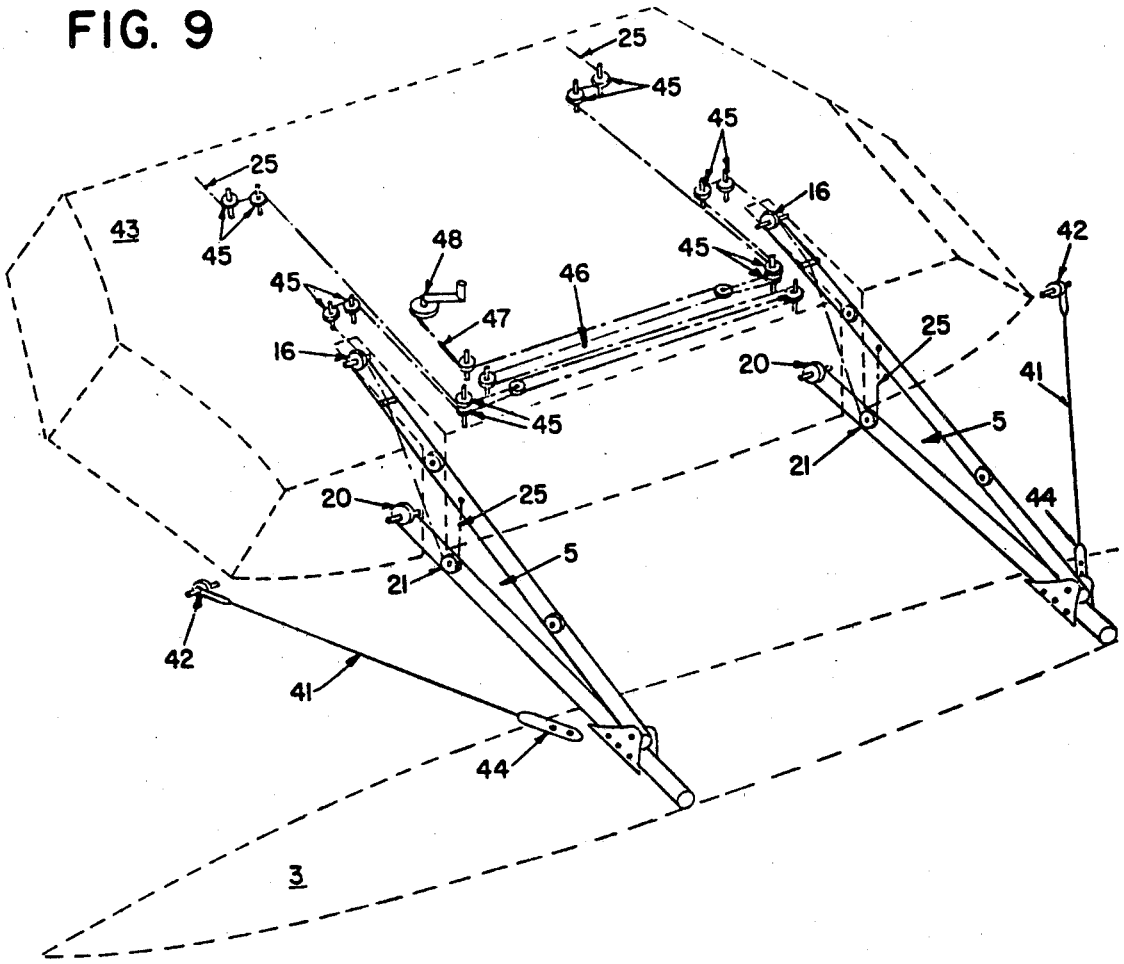
FIG. 9 is a perspective view of the pair of port float arm assemblies, an embodiment of one type of float position adjusting rigging with inboard means for controlling this rigging collectively for each float arm assembly and diagonal braces or stays between the port side of the superstructure of the center section and the deck of the port float, which are illustrated with dotted lines.

FIG. 9 is a perspective, somewhat schematic view of the pair of port float arm assemblies 5, illustrating the embodiment of FIG. 7 of the float fold-down rigging 25 for these arms, one particular embodiment of a system for common adjustment and control of all four float fold-down rigging lines and illustrating diagonal stays 41 between the float 3 and the center section 1. The diagonal float stays 41 are pivotally mounted at pivots 42 located on the center section superstructure 43 with longitudinal axes on a common line with lower float arm inboard pivots 20 and are fixedly mounted at points 44 on or near the deck of float 3, the superstructure 43 and the deck of float 3 being shown in dotted outline. The float stays 41 are located in a substantially horizontal plane under tension when the float 3 is in its normal laterally extended position with the lower arms 10 in an essentially straight orientation. The float stays 41 will remain under tension at an oblique angle to a vertical transverse plane as float height is changed, without altering the angle between lower arm segments 14 and 15 at pivots 21 and will remain in an essentially common plane with lower arms 10 in such a circumstance to provide resistance to fore and aft bending of float arm assemblies 5. If lower float arm joints 21 are buckled at least slightly downward and if upper float arm joints 18 are buckled at least slightly upward with float fold-down rigging lines 25, float returndown lines 26 and float stays 41 all under tension and all of fixed length, rigid float arm assemblies 5 can be maintained with no rotation of float arm segments around any pivots. This rigid package of float arm assemblies 5 could even be maintained in some circumstances without tension on some of the float-arm-control rigging lines 25 or 26 if float shrouds 8 are maintained under tension or if upward (buoyant) force is applied to the float 3. If lower float arm joints 21 are buckled slightly downward as just described, with diagonal stays 41 under tension, the float 3 could be raised by shortening float fold-down rigging lines 25 while allowing float return-down rigging lines 26 to lengthen if auxiliary pulleys 33, 34, 35 and 36 are appropriately positioned, as previously discussed for FIG. 8. Releasable or adjustable devices such as lever locking mechanisms or turnbuckles could be employed with diagonal float stays 41 to switch or adjust these stays between lengths at which the lower float arms 10 could pass through positions in which they are fully straight at joints 21 to positions at which they must remain buckled at joints 21.

The embodiment of one method for bringing control of float fold-down rigging 25 to a central location, as illustrated in FIG. 9, has the control rigging line brought from upper arm inboard pivots 16 via fixedly located tension redirecting pulleys 45 and block and tackle 46 with a common fall 47, all under the deck of superstructure 43, to a single winch 48, which could be in the cockpit. The float returndown rigging lines 26 could be handled with a similar arrangement of control means. In this example both fore float-arm control rigging lines 25 are brought to a common pulley in block and tackle 46 and are constrained to adjust in length by the same amount as are both aft float-arm rigging lines 25. With this arrangement of the control block and tackle 46 fore and aft rigging lines 25 and hence joints 16 through 21 of fore and aft float arm assemblies 5 are permitted to adjust by different amounts in response to different forces on the fore and aft ends of the floats 3. Such tension balancing adjustments would occur in addition to those between the two types of float control rigging 25 and 26 within one float arm assembly 5.

Figure 10:
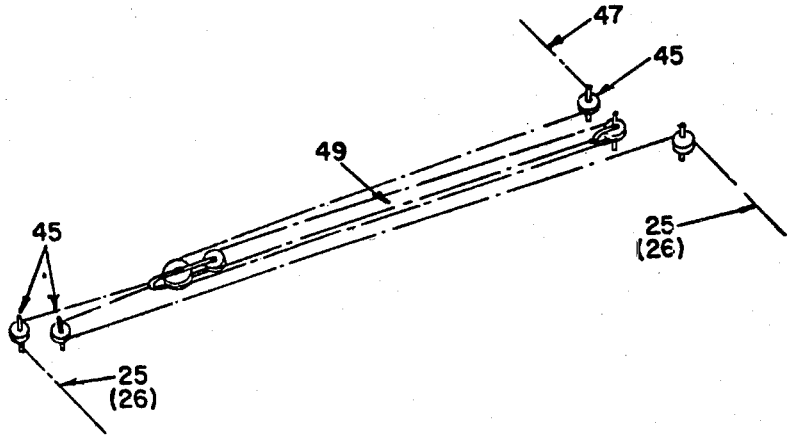
FIGS. 10, 11, 12 and 13 are fragmentary perspective views of alternate embodiments of float position adjusting rigging.

An alternate arrangement of block and tackle 49 is illustrated schematically in FIG. 10 for common control of float arm rigging lines 25 or 26 in which both fore and after lines are constrained to adjust in length by equal amounts. The rigging lines for only one float are shown joined at a common point but the same lines from the other float could also be brought to this point using additional tension redirecting pulleys 45. Independent block and tackle arrangements 46 or 49 of the types shown in FIG. 9 and FIG. 10, respectively, could be employed separately for the starboard and port floats 2 and 3 using common or separate winches 48. It is certainly possible even to have separate block and tackle and/or winches for each of the four rigging control lines of each type.

Figure 11:
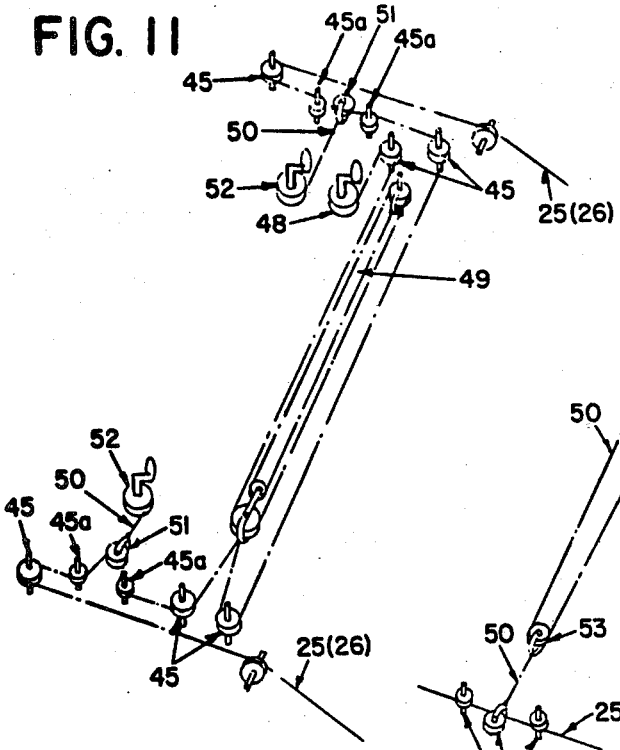

Separate, additional take-up rigging could be provided for each individual float control rigging line 25 or 26 which is brought to any of the arrangements of block and tackle 46 and 49 for controlling any type of float control rigging lines such as float fold-down rigging lines 25 or float return-down rigging lines 26 together for fore and aft float arm assemblies 4 or 5 and separately or together for starboard float arm assembly 4 and port float arm assembly 5. As illustrated in FIG. 11 these could consist of lines 50 from pulleys 51 riding on the control lines 25 or 26 between pairs of tension redirecting pulleys **45*a*, fixedly located on opposite sides of float control rigging lines 25 or 26 from pulleys 51, to winches 52, located on the same side of control rigging lines 25 or 26 as tension redirecting pulleys 45*a***.

Figure 12:
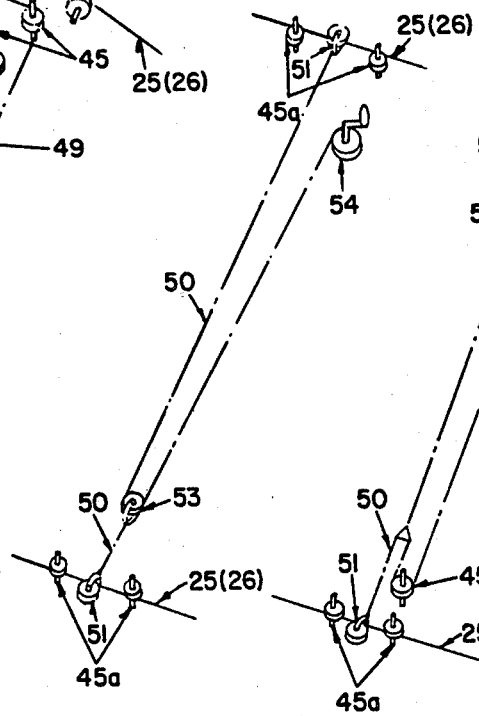

Alternate auxiliary means for providing common control of fore and aft rigging lines of one type for one float independently are illustrated in FIG. 12 using take-up rigging 25 or 26 of the type illustrated in FIG. 11. Only a section of float arm rigging lines 25 or 26 are shown leading to block and tackle of either of the types shown in FIGS. 9 and 10. In this embodiment control lines 50 from take-up pulleys 51 riding on float arm rigging lines 25 and 26 between tension redirecting pulleys **45*a* fixedly mounted on opposite sides of the rigging lines 25 or 26 are controlled by a single winch 54. One control line 50 of fixed length terminates at pulley 53 around which the other control line 50 is led to the winch 54. This arrangement provides independent control of one float of the force-balancing type in which fore and aft float rigging control lines 25 or 26 are permitted to adjust in length by opposite amounts in response to different forces at the ends of the float 3. The adjustment provided by this arrangement is additional to that provided by any common float control block and tackle such as those illustrated in FIGS. 9 and 10. In this arrangement twice as much tensional force will be applied on one line 50 as on the other. Should this not provide an advantage, a second pulley could be provided for block 53 and the load on this line 50** could be divided by leading it around this additional pulley to a fixed termination.

Figure 13:
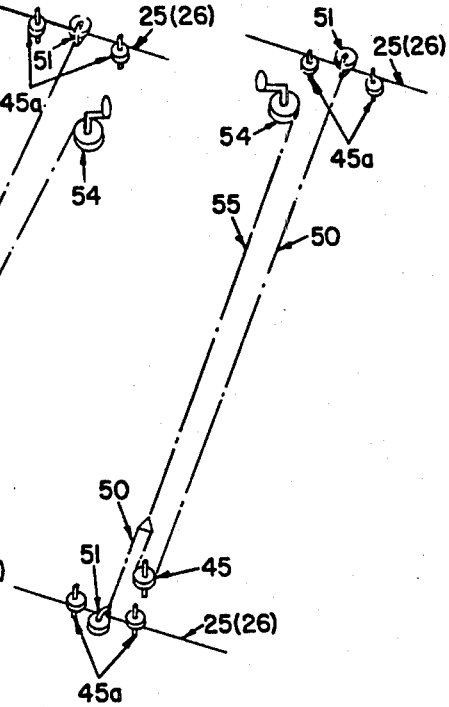

Further alternate auxiliary means for providing common control of fore and aft rigging lines of one type for one float independently are illustrated in FIG. 13 using an arrangement similar to that illustrated in FIG. 12 except that the additional adjustment in length of float arm rigging lines 25 or 26 must be of equal amount. Control lines 50 from each take-up pulley 51 are joined at a common point, one of these lines 50 being led around a fixedly mounted tension redirecting pulley 45, and thence to a single winch 54 via a common fall 55.

In place of the single fall 50 or 55 leading to winch 54 in FIG. 12 or FIG. 13, a block and tackle arrangement could be inserted if additional mechanical advantage is desired.

Either or both auxiliary means for providing common control of fore and aft rigging lines for one float illustrated in FIGS. 12 and 13 could be used with either primary means for providing common control of fore and aft rigging lines illustrated in FIGS. 9 and 10 for floats 2 and 3, separately or commonly, and could be provided in addition to means for individual rigging line control illustrated in FIG. 11 in any combination, but it is readily apparent that certain combinations offer no conceivable advantage.

Any of the block and tackle arrangements illustrated in FIGS. 9 through 13 for control of float arm rigging lines 25 or 26 could be located in the floats 2 and 3 with appropriate means for bringing the fall from such block and tackle arrangements to winches or mechanisms for controlling the winches at a central location. To bring float rigging lines 25 or 26 to these arrangements in the floats, fixed terminations 27, **27*a*, 30 or 30*a*** could be replaced with auxiliary pulleys.

Means other than block and tackle and centrally located winches could be employed to control float arm rigging lines 25 or 26 from a central location. These could include electric-motor-driven winches anywhere inboard of the entry into the center section superstructure 43 of individual rigging lines 25 or 26 with appropriate electrical switches or controls at the central location or mechanical systems employing gears, shafts, chains and sprockets and cranks for operating such winches.

Means other than rigging lines and pulleys within the float arm assemblies 4 and 5 could be used to control the orientation of float arm segments 11 through 15. In particular, hydraulic pistons or other suitable longitudinally extendible means pivotally mounted between pairs of float arm segments, between float arm segments and the center section, between float arm segments and the associated floats or even between the center section and the floats could be employed in suitable combination to perform any of the functions previously described in terms of float arm control rigging lines 25 and 26, replacing or supplementing such rigging. Hydraulic pistons could even be substituted for any of the float arm segments 11 through 15 and changes in the variable length of such segments could be effected for any purposes of controlling float height, float attitude or float displacement from the center section. Hydraulic fluid lines could be brought from these pistons into the center section 1 to hand-driven or electric-motor-driven pumps which could be operated from a central location to control the action of these pistons.

Various current or voltage regulating devices, servomechanisms or other electrical sensors, magnetic relays or other electrical switching circuits such as digital logic circuits could be employed to operate electrical winch motors, electrically-driven hydraulic pumps or electrically-driven geared devices to translate the position or movement of various levers or sensing devices into changes of float position or attitude in any of the modes or combinations described herein. Hydraulic switching circuits employing differential hydraulic valves activated by mechanical means such as levers or by such electrical systems could be designed according to known methods of analysis to control the action of any of the hydraulic pistons from one common, manually or electrically driven pump in any such selectable modes or combinations of float adjustment.

In this description of float arm assemblies 4 and 5 of the preferred and alternate embodiments of the present invention several assumptions would appear to have been made. In particular, the axes of all pivots and auxiliary pulleys within the float arm assemblies 4 and 5 are presented as being parallel to the longitudinal (fore and aft) axis of the center section 1. The float arm segments 11, 12 and 13 of upper float arms 9 and segments 14 and 15 of lower arms 10 may be assumed to have longitudinal (lengthwise) axes which are substantially collinear when the arms are "straight" in the normally laterally extended positions for sailing and which lie in vertical planes, transverse to the vessel's longitudinal axis. Internal float control rigging lines 25 and 26 may be assumed to lie in these same vertical planes. The axes of all pivots 16 through 21 and auxiliary pulleys and sleeves 28 and 31 through 40 are thus assumed to be perpendicular to these vertical planes and may also be assumed to intersect the longitudinal axes of the float arm segments 11 through 15. Virtually no constraint was assumed to limit the rotation of the arm segments around internal pivot axes from an angle of 0 degrees between the longitudinal axes of adjacent arm segments to an angle of 360 degrees between such segments due to the physical nature of the arm segments and the joints or due to interference from pulleys or rigging elements. Finally, the location of the various auxiliary pulleys 31 and 33 through 39 may be assumed to be fixed along the length of the float arms 9 and 10.

The implementation of preferred and alternate embodiments of this invention is not constrained by these assumptions. Float arm segments could be laterally displaced from each other and would thus not physically constrain the limits of rotation of adjacent arm segments around internal joint axes. To the extent that the upper arms 9 and lower arms 10 are not constrained by float control rigging lines 25 and 26 connected between them, the float arms 9 and 10 may even be displaced from a common, substantially vertical plane. Auxiliary pulleys could be displaced above, below or beside longitudinal axes of the float arm segments or outside of the float arm segments if necessary to produce tensional forces on float control rigging lines 25 and 26 between tension directing pulleys or sleeves within the float arm assemblies 4 and 5 which will achieve the balance of forces on the float arm segments 11 through 15 required to maintain the desired orientations of these segments or if necessary to locate the float control rigging elements where they will not interfere with desired rotation of float arm segments. The axes of float arm pivots 16 through 21 could be inclined slightly from the horizontal with the planes of the float arm assemblies 4 and 5 rotated through the same angle from their vertical planes to remain perpendicular to the pivot axes so that floats 2 and 3 would move fore or aft in a desired manner as float height is altered by rotating float arm segments 11 through 15 around these joints. Pivots 18 could be configured as hinges with axes displaced below the arm segments 12 and 13 so that these segments could be folded against each other in the extreme raised position of the floats 2 and 3 and so that the segments would butt against each other in the fully straight position and prevent back-buckling at this joint. One or more float arm segments 11 through 15 in each float arm assembly 4 and 5 could be a U beam into which adjacent arm segments could recess and thus rotate through angles from 180 degrees (straight) to 360 degrees (fully folded) with respect to the U beam segments. Such U-beam shaped segments could be extended past the joints with adjacent arm segments to limit these segments from rotating to angles of less than 180 degrees (back-buckling) with respect to the U beam segments. Finally, any of the auxiliary pulleys 31 and 33 through 39 could be mounted in asemblies which move in or along the arm segments on sliding tracks or which pivot to alter their displacement above or below the longitudinal axes of the float arm segments along which they reside. Such assemblies could be locked temporarily in place by manually operated means and, in the absence of such locking mechanisms or with such locking mechanisms released, these assemblies could be provided with resilient means which would allow the assemblies to move in response to varying forces and thus to contribute to maintaining desired orientations and response of float arm segments.

It is further assumed for most of the applications of this invention herein described that inner arm segments 11 are never permitted to rotate lower than positions substantially parallel to, and probably recessed within and flush with the deck or upper surface of the center section 1. It is also assumed that, except for possible slight buckling, previously described, float arm segments adjacent to internal pivots 17 and 21 will maintain substantially collinear (or parallel) orientations with respect to each other when the floats 2 and 3 are raised above the normal laterally extending sailing position and that a similar relation will apply for internal pivots 18 when floats 2 and 3 are lowered below the lateral position.

There are applications in which exceptions to these last assumptions would be desirable. In particular, the longitudinal planes most closely approximating a symmetrical bisection of the floats 2 and 3 could be caused to rotate a small amount around the longitudinal float axes, increasing their inboard tilt with respect to the vertical by a downward buckling of internal float arm joints 21 and probably also of joints 17 to lessen the effect of increasing heel on the trim of the leeward float. Such downward buckling of joints 17 would require internal float arm segments 11 to rotate below positions parallel to the deck. Protruding edges within center section superstructure 43 or other mechanisms restraining arm segments 11 could be displaced or released for such an application. In one application requiring asymmetric adjustment of float arm assemblies 4 and 5 it is desired to raise one float over the deck of the capsized vessel further than the other toward, or past, if possible, the centerline of the center section 1 for the purpose of recovering from capsize in a chosen direction. In another application requiring asymmetric float arm adjustment it is desired to lower one float under the superstructure 43 of the center section 1 further than the other toward or past the keel, if possible, for the purpose of deliberately capsizing the vessel in a chosen direction. Downward rotation of inner upper arm segments 11 for such a float past the normal limiting position parallel to the deck might be required to move the float further toward, or past, the keel than would be possible in a symmetric operation of the floats.

There are applications in which it may be desired to lower the floats to the sides of a center hull with the outboard sides of the floats at or beneath the level of the keel of the center hull, the floats being oriented with outboard sides relatively horizontal to enable the vessel to act as a shoal draft vessel of width no greater than that of the center section or to provide greater stability and comfort in a standard width berth. Such a capability for positioning the floats at or below center hull keel depth (with center board raised, if any is used) could also be utilized to provide support for beaching, storing, launching or transport.

With a float arm configuration according to the present invention, permitting floats 2 and 3 to be retracted to the sides of or beneath the center section and to be supported by self-contained rigging or mechanisms, it would be possible to attach, temporarily or permanently, to the outboard sides of the gunnels of such floats, wheels, skates, skis, bumpers or skids and to switch the vessel into a mode of operation appropriate to these devices merely by lowering the floats.

Additional extendible, jointed or pivoting members could be added to the basic configuration of float arm assemblies 4 and 5 illustrated in FIGS. 1, 2 and 3 or to alternate embodiments of such assemblies as described herein to extend the degrees of freedom by which float position or attitude may be varied without special adjustment of the basic configuration. An example of such application is the rotation of floats around their longitudinal axes to bring hydrofoil or planing surfaces into operational position. To permit such an application the outer ends of the lower arms could be made pivotally attached to the floats or to the upper arms instead of fixedly attached to the floats. Suitable extendible or jointed means could be provided between upper and lower arms or between either arm and the float, according to principles, already described, of the present invention, to effect such float adjustments.

Figure 14:
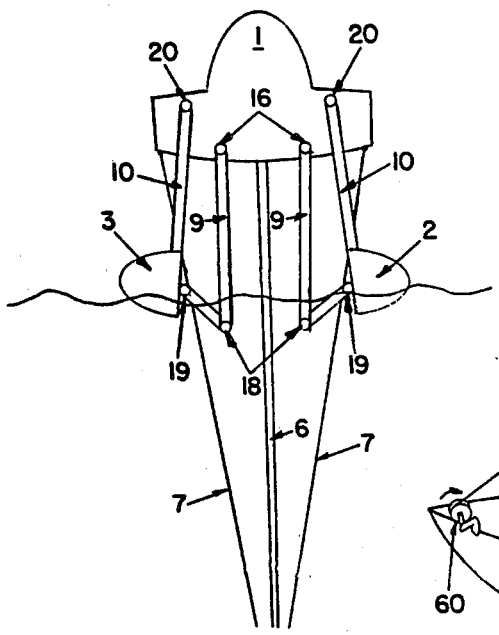
FIG. 14 shows in cross-sectional outline a trimaran according to the invention in a capsized position with floats raised with respect to the upright vessel downwardly and inwardly beneath the deck of the capsized vessel as far as taut main hull shrouds from a fully raised mast will permit.

FIG. 14 illustrates in cross-sectional outline of a trimaran according to the invention the relative positions of floats 2 and 3 and of affected elements of float arm assemblies 4 and 5 when said floats have been pivotally "raised" as far inward "over" the center section 1 of the capsized vessel as center hull shrouds 7 will permit in a fully taut condition with the mast 6 in an erect position. In the illustrated example the combined buoyancy of the floats in this position is sufficient to lift the center section 1 out of the water. It can readily be seen that the center of gravity would be situated higher than the center of buoyancy in this orientation and that, as long as the largest fraction of the volume of both floats remains underwater, the equilibrium at 180 degrees of heel will be unstable. If, in heeling from the fully inverted position, one float partially emerges from the water while part of the superstructure on the side toward which the keel is leening submerges a compensating amount, an angle of lean will be reached at which the resultant center of buoyancy moves laterally toward that side through a distance greater than that through which the center of gravity moves. Beyond that angle of lean the center of buoyancy will provide a restoring moment to keep the vessel capsized in metastable equilibrium. If the separate centers of buoyancy of the floats remain relatively widely spaced, as shown in FIG. 14 with hindrance provided by shrouds 7, correspondingly large external leverage must be applied to right the vessel. If the floats 2 and 3 can be brought sufficiently close together "over" the center section 1 to reduce the region of metastability to a few degrees around 180 degrees, sufficient leverage to right the vessel could be provided by a wind which is relatively light compared to that which capsized the vessel.

The simplest solution for removing the hindrance provided by shrouds 7 would be to release or relax said shrouds. This method could possibly result in dismasting or damage to mast 6 or to center section 1 where it is stepped. An alternate and preferred solution for removing the hindrance of shrouds 7 to bringing floats 2 and 3 together "over" the deck of the center section is provided by pivotally lowering (with respect to the upright vessel) said shrouds toward the deck of said center section along with mast 6. The lowering and subsequent re-raising of mast 6 is a basic component of the present invention with various applications both when performed independently of changes in float position and when performed in conjunction with the raising and subsequent relowering of floats 2 and 3.

Figure 15:
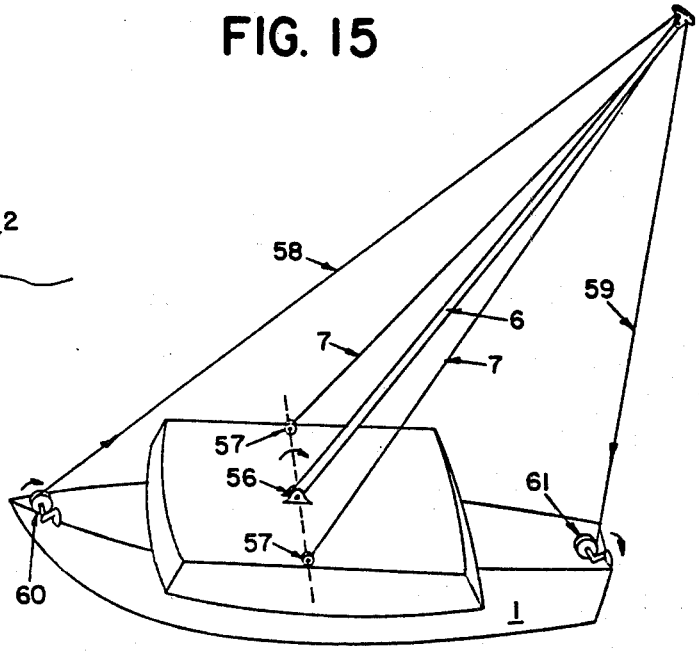
FIG. 15 is a simplified and somewhat schematic perspective view of the center hull of a trimaran according to the invention with the mast partially lowered pivotally by means of adjusting the length of fore and aft mast stays.

FIG. 15 is a perspective view of a trimaran according to the invention wherein a mast 6 pivotally mounted at its base 56 and elements of standing rigging are shown in somewhat schematic representation together with the center section 1 in outline to illustrate a method in its simplest form for raising and lowering mast 6 and shrouds 7 as a unit. The shrouds 7 are attached to center section 1 at pivots 57 which are transversely collinear with mast pivot 56; thus the shrouds 7 and the line through pivots 56 and 57 form a triangle bisected by the mast 6 and thus shrouds 7 remain under constant tension in a common transverse plane with mast 6 as the angle between the mast and the vertical is varied from 0 degrees to 90 degrees in either the fore or the aft directions. Forestay 58 and backstay 59 are adjustable in length between the masthead and the bow and stern, respectively, with means for adjusting these lengths being represented by winches 60 and 61 in the bow and the stern, respectively. One stay may be reeled out to increase its effective length by a given amount while the other stay is being reeled in by a compensating amount to effect a corresponding change in the angle which the mast makes with the vertical.

In order to bring the floats 2 and 3 as close together "over" the deck of center section 1 as the float arm geometry will allow without the floats being interfered with by the shrouds 7 under tension, it would be necessary to lower the mast 6 to an angle with the vertical at which the distance between shrouds 7 is less than the distance between the floats at the height of least separation of the floats. When the mast 6 has been lowered far enough toward the deck to intercept the transverse vertical plane within which the fore or aft pair of port and starboard float arm assemblies 4 and 5 are situated and within the space between raise float arms 9, interference of the shrouds 7 with float arms 9 must be considered. The base of the triangle between shrouds 7 need not actually be shorter than the distance between port and starboard inboard upper arm pivots 16 in order for such shrouds not to interfere with upper float arms 9 as the floats 2 and 3 are raised. It is sufficient for the transverse width of the triangle to be less than this distance at a height above pivots 16 equal to the fore and aft distance between the shroud pivots 57 and the float arms 9 which shrouds 7 must accommodate in order for shrouds 7 to be able to remain taut without interfering with float arms 9 when floats 2 and 3 are raised and the mast 6 is sufficiently lowered.

By placing the shroud pivots 57 sufficiently lower than the mast pivot 56 or further toward the end of the vessel toward which it is desired to lower the mast, the shrouds 7 would become sufficiently relaxed to accommodate the floats without fully lowering the mast. The distance by which to displace shroud pivots 57 to fully accommodate floats 2 and 3 at a chosen minimum angle of the mast with the vertical can be calculated according to known methods of analysis. A combination of narrower base shrouds which remain taut and of wider base shrouds which are stepped to relax as the mast is lowered or of releasable shrouds might be employed. Alternatively, means might be provided in the form of sliding tracks in the fore and aft direction to permit varying the amount by which shroud pivots 57 are biased fore or aft of mast pivot 56.

As the mast 6 is lowered toward one end of the vessel, the perpendicular distance between pivot 56 at the base of the mast and the stay 58 or 59 extending to the other end of the vessel decreases. As the triangle between the mast and this stay collapses, the moment for re-raising the mast becomes zero no matter what force is applied to the winch 60 or 61 to which this stay is attached. The simple method illustrated in FIG. 15 can therefore not be used unaided to re-raise the mast 6 after it has been lowered all the way to the deck of the center section 1 and means would have to be provided for propping up the mast or the stay.

Figure 16:
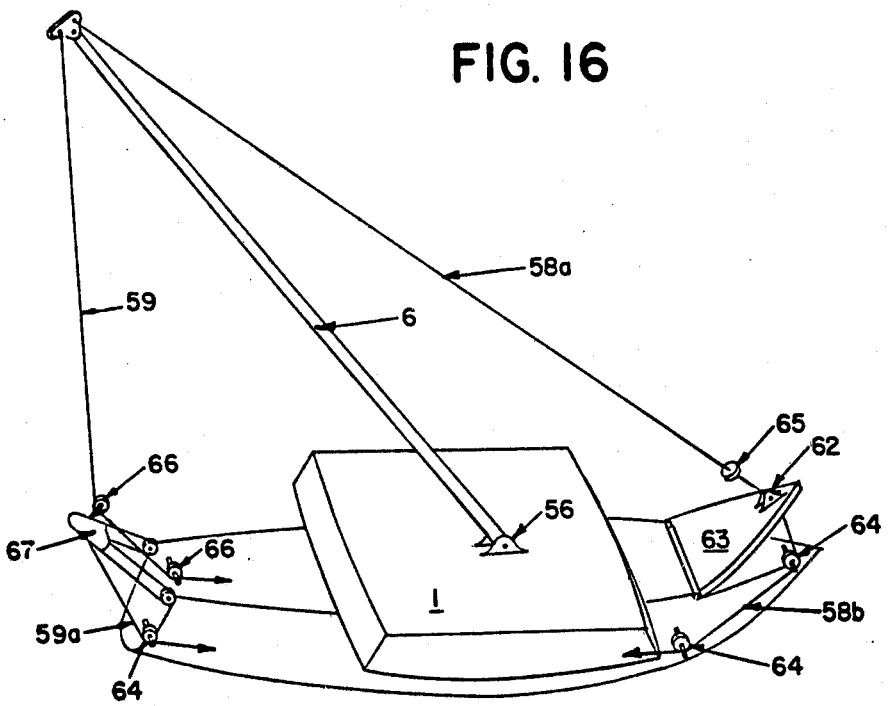
FIG. 16 is a simplified perspective view similar to FIG. 15 illustrating means in the form of triangular frames pivoting along their base on the main hull for purposes of extending the leverage on the mast applied by the fore and aft stays above the deck or beyond the length of the main hull.

FIG. 16 shows in a similar view a pair of modifications to the method illustrated in FIG. 15 for changing the angle of the mast with the vertical in which either fore or aft mast stays of either fixed or variable length could be stepped on the apexes of triangular supports which are pivotally connected around axes along the base of these triangles transverse to the centerline of the vessel and in which rigging from the underside of such triangular supports could be used to control the height of the apexes of such triangles and hence the effective length of the mast stays. In one embodiment of such a modification forestay **58*a* of fixed length is stepped at point 62 on the apex of triangular support 63, which lies parallel and flush with the fore deck of center section 1 when the mast 6 is in its normal vertical position and rigging 58*b* from the underside of triangular support 63 is led via tension directing pulleys 64 within the center section to a winch or other means (not shown) for adjusting the length of line 58*b*. The use of such fixed length forestays 58*a* could make possible the use of roller reefing mechanism 65. In the other embodiment of such modification backstay 59 of variable length is led via tension directing pulleys 66 at the apex of triangular support 67 and in the center section 1 to a winch or other means (not shown) for adjusting its length. The triangular support 67 in this modification extends aftward from the stern of the center section 1 and is used primarily to extend the base of the triangle between the mast 6 and the backstay 59 but rigging 59*a*, which is led from the underside of triangular support 67 via tension directing pulleys 64 to a winch or other means (not shown) for adjusting the length of line 59*a* and which is used to control the height of the apex of triangle 67, provides alternate means for adjusting the effective length of backstay 59**.

Figure 17:
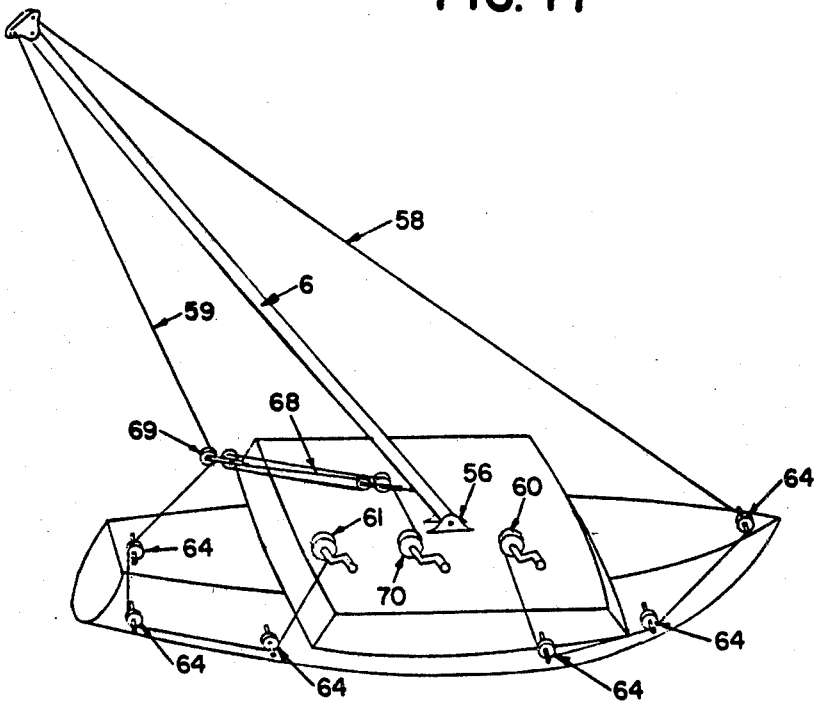
FIG. 17 shows in similar perspective view alternate means for effectively shortening the length of one of the mast stays.

FIG. 17 shows in similar perspective view of center hull 1 and mast 6 with forestay 58 and backstay 59, led via tension directing winches 64 to centrally located winches 60 and 61, as described for FIGS. 15 and 16, alternate means for changing the effective length of backstay 59 in the form of block and tackle 68, extending between pulley 69, which rides on the backstay 59, and a point near the base of the mast 6 with the fall of block and tackle 68 being led to winch 70. Without changing the actual length of backstay 59, as accomplished using the primary method described for FIGS. 15 and 16, the triangle between mast 6 and backstay 59 can be collapsed by shortening block and tackle 68. This alternate arrangement provides better leverage as well as better mechanical advantage (useful when the vessel is capsized) than the primary method of shortening backstay 59 as the triangle between mast and backstay becomes nearly collapsed and the head of the mast extends substantially beyond the end of the vessel. An additional advantage is that backstay 59 remains fixed in length so that the mast 6 could be easily restored to the same trim angle when the forestay 58, which would have to be allowed to lengthen as the mast 6 is lowered, is shortened again to its former length. When not in use, block and tackle 68 could be relaxed or released from pulley 69 and stowed on deck. A similar arrangement could be used for the forestay 58 if it is desired to lower the mast 6 toward the bow.

Figure 18:
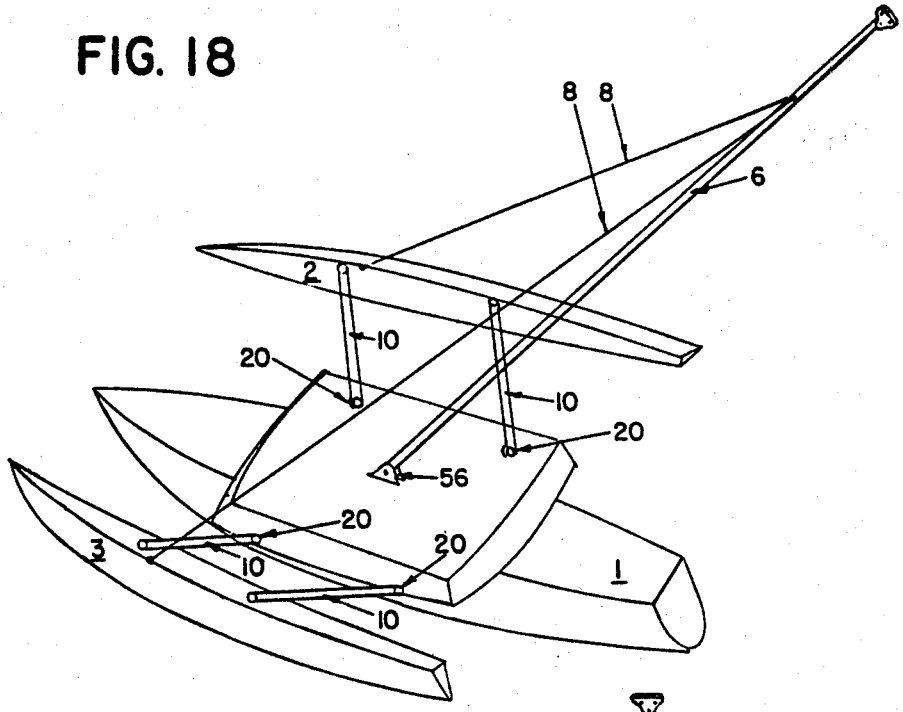
FIG. 18 shows in perspective view from above a simplified representation of a trimaran according to the invention in which lowering of the mast is being used to effect the lifting of the floats by means of tensional force applied through float shrouds.
Figure 19:
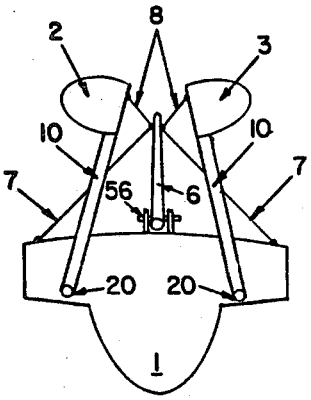
FIG. 19 shows in cross-sectional outline of a trimaran according to the invention the inward force on the floats due to tension on floats shrouds after the mast has been lowered and the floats raised beyond the point at which the float shrouds would lie in a horizontal plane.

FIG. 18 shows in perspective view from above, a simplified representation of a trimaran according to the invention in which mast 6 is being lowered toward the stern around pivot 56 near its base using any of the means (not shown) discussed for FIGS. 15, 16 and 17 and in which float shrouds 8, stepped forward of the mast and of fixed length are causing floats 2 and 3 to be pivotally raised around inboard pivots 20 of lower float arms 10. Other components of standing rigging or of float arm assemblies, which change length or orientation in conjunction with the operation illustrated in FIG. 18 but which are not essential to understanding the action illustrated have already been discussed in detail and are left out of this simplified representation. The distance by which float shrouds 6 must be stepped forward of the mast 6 to cause floats 2 and 3 to be raised to a given angle of arms 10 with the vertical and for a given point of connection of the mast 6 for shrouds 8 can be calculated with standard methods of analysis. As the mast 6 is being lowered to an angle of inclination at which the shrouds 8 lie in a horizontal plane an upward component of force is generated to lift the floats 2 and 3. As the mast 6 is lowered further the inward component of force due to shroud tension will pull the floats together in a continuation of the pivoting action, as illustrated in FIG. 19 making special rigging to do this unnecessary. A similar operation could be carried out with the mast 6 being lowered toward the bow and with the shrouds 8 being stepped toward the stern. The distance by which shrouds 8 are stepped forward or aft of the mast 6 could be made variable by terminating the shrouds 8 on a mechanism which slides in a track on the deck of floats 2 and 3. The position of float shrouds 8 could thus be adjusted to alter the amount by which floats 2 and 3 will be raised (or allowed to lower) for a given angle of the mast 6 and the means for controlling the adjustment mechanism could consist of a manual locking/releasing device or of a block and tackle arrangement.

After floats 2 and 3 have been raise above the deck of center hull 1, as illustrated in FIG. 18, by lowering the mast 6 to create a lifting tension on the floats, the return of the floats to their laterally extended positions, using means previously described (return-down rigging 26), can be used to re-raise the mast in the reverse of the operation just described. An upward force will be generated on the mast 6 by shrouds 8 until the mast has been sufficiently raised for shrouds 8 to lie in a horizontal plane. When the mast has been raised past this angle, a forward component of force applied at the head of the mast by the shrouds 8 will be sufficient to continue the raising of the mast by causing a rotational moment on the mast 6 around pivot 56 at its base. Any action employing the float shrouds 8 in the raising of the mast 6 would be additional and optional to means described for FIGS. 15 through 17.

The motive force for "lowering" the head of the mast (with respect to the upright vessel) toward the deck of the center section 1 could be provided, when the vessel is capsized, by means of buoyancy of fixed size or of inflatable size and permanently mounted at the head of the mast or hoistable by means of a halyard. With such buoyancy in place and with means provided for releasing one of the stays 58 or 59 the motive force for raising the floats above the deck according to the description of FIG. 18 could thus be provided. If the release of said stay and inflation or hoisting of said flotation device is made self-initiating by appropriate means, the vessel could be made essentially self-righting, at least to the stable position on its side with floats raised, as illustrated in FIG. 6(d). The final stage of recovery from capsize would require lowering of the floats 2 and 3 to the normal, laterally extended position.

It has been assumed for the method described in FIG. 18 for raising/lowering floats 2 and 3 in conjunction with lowering/raising the mast 6 that the length of the float shrouds 8 would be kept fixed, at least during the operation. If the lengths of said shrouds are also made variable under helmsman's control, with the extensions of variable-length float shrouds **8*a* being led via pulleys on or in the floats 2 and 3 and thence to winches or equivalent devices, the manipulations of mast angle and float height can be made independent of each other at the helmsman's disgression. The effective length of float shrouds 8*a* could be decreased by such means to raise the floats without changing the angle of the mast if the mast stays are not released. If, on the other hand, the mast is lowered to the deck in a capsize recovery as the means for raising the floats above the deck, as described for FIG. 18, the winches for controlling float shrouds 8*a* could then be released so that the mast could be left on deck while the floats are independently re-lowered. If, the float return-down rigging 26 is not released, the mast can be lowered/raised independently by the means for adjusting the length of these shrouds. Variable length float shrouds 8*a* would have a further function of permitting the lowering of floats 2 and 3** past their normal laterally extending positions without the necessity of releasing said shrouds.

Figure 20:
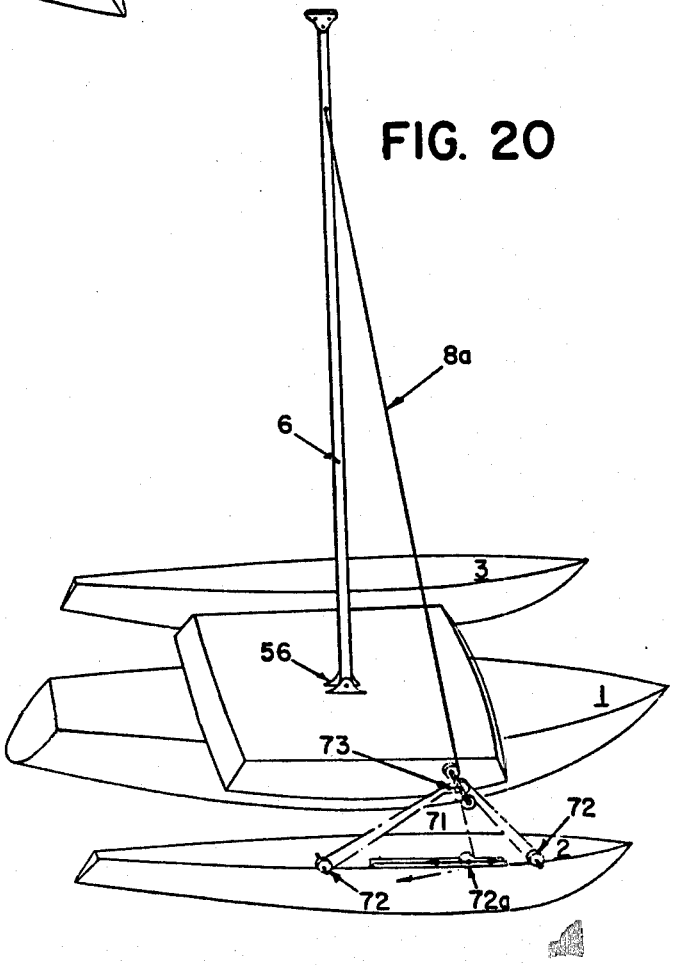
FIG. 20 shows in a simplified, somewhat schematic perspective view of a trimaran according to the invention means for adjusting the length and effective point of connection on the floats of the float shrouds.

FIG. 20 shows in simplified perspective view of a trimaran according to the invention, the center hull 1, floats 2 and 3, mast 6 and one float shroud **8*a* employing block and tackle arrangement 71 to vary the effective length of shroud 8*a* between a point on mast 6 and float 2. Block and tackle configuration 71 is connected at a plurality of points along the length of float 2 by single pulley blocks 72. The upper block 73 consists of a plurality of pulleys, one for each float deck pulley 72, and the shroud 8*a* is led in turn around each of the pulleys of block 73 to one of the pulleys 72. The fall of block and tackel 71, which is the extension of shroud 8*a*, is led via tension directing pulleys or other means (not shown) from one of these deck pulleys 72*a* to a winch or other means for adjusting its length from a central location. Block 73 is suspended between its points of connection on float 2 and mast 6 at a location in which a balance of forces will be attained in the plane of the rigging. As the angle of the mast 6 with the vertical is altered or the length of the shroud 8*a* is varied, both the effective length of an equivalent fixed shroud 8 and the effective point at which it would step on the float 2 may vary. By appropriate location of pulleys 72 along the float 2 an improved relationship between upward force and longitudinal force can thus be realized over an arrangement with a fixed single point of connection to the float 2 throughout the whole range of angles which mast 6 can assume with respect to the vertical. Not only can the upward component of tension exerted by the mast 6 on shroud 8*a* be increased relative to the longitudinal component; the twisting moment on float 2 around the points of connection of float arm assemblies 4 can be reduced. Additional control over this relationship can be obtained by placing any of the pulleys 72 on a sliding track, as illustrated schematically for pulley 72*a*, so that its fore and aft position can be adjusted. If the change in float height for a given change in mast angle with no change in shroud length is not sufficient for the given location of the set of pulleys 72, the distance from any of the pulleys 72 or from the mast 6 to block 73 can be constrained in an alternate embodiment of block and tackle configuration 71** by replacing or supplementing the segment in question of shroud 8*a* with one of fixed length or by otherwise replacing any of the pulleys 72 or 73 with a fixed termination for shroud 8*a* or now separated lengths of tackle in the block and tackle arrangement 71.

The foregoing specification of the present invention describes principally a particular embodiment of this invention involving internally jointed upper and lower float arms and rigging internal to assemblies of these arms for controlling the orientation of float arm segments relative to each other and of the floats relative to the center section. Alternate and optional features were included in the discussion to demonstrate the flexibility of capabilities inherent in a design base on this concept. Among the potential advantages of such a system are:

(1) the range and degrees of freedom of float and rigging adjustability;
(2) the large number of selectively independent or coordinated operational capabilities possible;
(3) in-place control means integral with rigging for normal sailing;
(4) exploitability of the resiliency of interconnected and dynamically balancing float height adjustment means and of the lack of rigid load-bearing outrigger structures for further improvements in performance, comfort and, especially, safety and
(5) feasibility of engineering design constraints such as conventional external appearance, simplicity, reliability and avoidance of expensive special materials and machinery components.

Various alternate embodiments are capable of providing many of the capabilities of the basic design described as the preferred embodiment. Some of these alternate embodiments and several additional embellishments upon the preferred embodiment, perhaps already mentioned in passing, will now be described.

Figure 21:
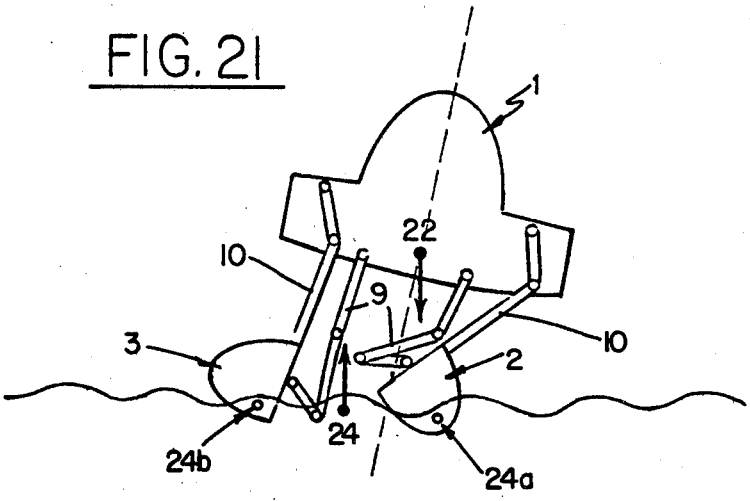
FIGS. 21 and 22 show in cross-sectional outline a trimaran according to the invention in a capsized position with floats raised with respect to the upright vessel asymmetrically downwardly and inwardly beneath the deck of the capsized vessel, with one of the floats disposed further inwardly than the other in FIG. 21 and with one of the floats disposed further downwardly than the other in FIG. 22.

FIG. 21 shows in cross-sectional outline of a capsized trimaran with floats 2 and 3 raised asymmetrically beneath inverted center section 1, float 2 displaced at least partially beyond the vertical centerline of the center section 1 relative to its laterally extended position. This action establishes a righting moment between center of gravity 22 and center of buoyancy 24 for righting in the chosen direction around float 2. If float 2 can be sufficiently displaced beyond center of gravity 22 relative to its laterally extended position, the region of metastability with center of gravity 22 located between vertical lines through the respective centers of buoyancy 24*a* and 24*b* of floats 2 and 3 will be eliminated and the capsized vessel will become absolutely unstable. It would be required for such an operation that the mast 6 be displaced from interference with such movement of float 2.

Figure 22:
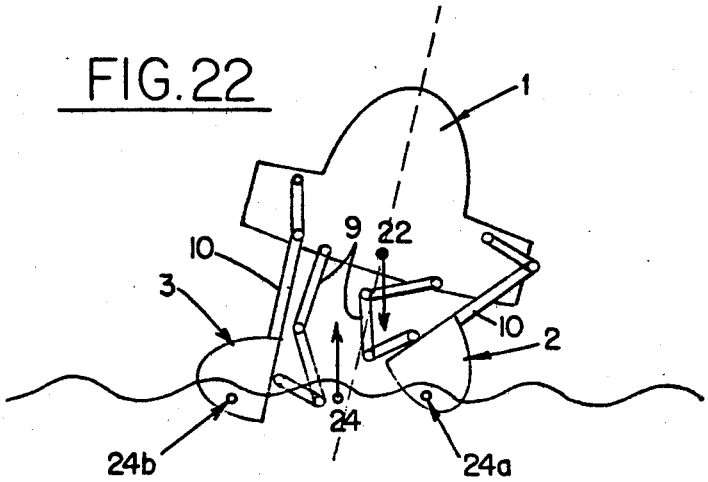

FIG. 22 shows in cross-sectional outline of a capsized trimaran with floats 2 and 3 raised asymmetrically beneath inverted center sectional, float 2 displaced substantially closer to the deck of center section 1 than float 3. The action is similar to that of FIG. 21 in establishing a righting moment between center of gravity 22 and center of buoyancy 24 for righting in a chosen direction around float 2. If the difference in the respective distances from floats 2 and 3 to the deck of center section 1 can be made sufficiently large, the center of gravity 22 will again be forced to move outside of the region between parallel vertical planes through the respective centers of buoyancy 24*a* and 24*b* of floats 2 and 3. It would not be required that mast 6 be displaced for such an operation.

FIG. 23 is a cross-sectional view of one float arm assembly 5 with hydraulic pistons 74 and 75 pivotally mounted between upper float arm 9 and lower float arm 10. The geometric configuration of float arm segments 11, 12, 13, 14, and 15 is the same as described for FIG. 1. The positions of internal joints 17, 18 and 21 separating these segments are maintained relative to the inboard pivots 16 and 20 connecting upper arm 9 and lower arm 10 to the center section 1 and outboard pivot 19 connecting upper arm 9 to float 3, with a balance of forces exerted at the internal rigging lines 25 and 26 as resisted by hydraulic piston 74 constraining the distance between its upper pivotal termination 76 in upper arm outer segment 13 and its lower pivotal termination 77 in lower arm outer segment 15 and as resisted by hydraulic piston 75 constraining the distance between its upper pivotal termination 78 in upper arm middle segment 12 and its lower pivotal termination 79 in lower arm outer segment 15.

The configuration of float fold-down rigging line 25 and float return-down rigging line 26 is very similar to those shown in FIGS. 7 and 8 and any variation of those configurations contained in the foregoing description of FIGS. 7 and 8 could be supplemented with hydraulic pistons or other suitable mechanically extendible members pivotally connected between pairs of float arm segments in the same arm 9 or 10 or between pairs of arm segments, one in each arm 9 and 10. The need for various of the tension directing devices associated with the internal rigging lines 25 and 26 can, in fact, be eliminated by the use of such mechanically extendible members and additional such extendible devices could clearly be introduced until the need for internal rigging lines is completely eliminated.

The action of hydraulic piston 74, when activated, is to rotate upper arm outer segment 13 outwardly around pivot 19, causing float 3 to be raised above its laterally extended position. Float return-down rigging line 26 can be used, when piston 74 is allowed to return to its retracted length, to cause a return of float 3 to its laterally extended position, in lieu of positive hydraulic action in retracting piston 74. Pivotal terminations 76 and 77 of piston 74 are arranged so that upper arm outer segment 13 will rest against lower arm outer segment 15 when piston 74 is fully retracted and will be maximally rotated outwardly when piston 74 is fully extended.

The action of hydraulic piston 75 is, first, to maintain a constant length between its termination points 78 and 79 during a raising of float 3 above its laterally extended position caused by action of float fold-down rigging line 25 on lower arm internal pivot 21 and, second, to retract to a shorter length permitting a lowering of float 3 below its laterally extended position, again caused by action of float fold-down rigging line 25 on lower arm internal pivot 21 in lieu of positive hydraulic action to accomplish this same action. Pivotal terminations 78 and 79 of piston 75 are arranged so that the piston is fully retracted when float 3 is in its fully lowered position.

Secondary adjustments of the hydraulic pistons 75 or 74 not principally involved in a float movement to achieve the final desired orientation of float arm segments should be small compared to the change in length of the principally involved piston 74 or 75 if the locations of termination points 76, 77, 78 and 79 are properly determined. These adjustments may be handled in a manner analogous to the secondary adjustment of rigging lines 25 and 26, as discussed for FIGS. 7 and 8.

FIG. 24 is a cross-sectional view of one float arm assembly 5 with hydraulic piston 80 replacing previously described upper arm segments 12 and 13 and with hydraulic piston 81 replacing previously described lower arm segments 14 and 15. Conventional hydraulic systems may be employed to control pistons such as these in FIG. 24 and those in FIG. 23 from the center section. Auxiliary float control rigging line 82 is led directly from a termination point fixedly attached to float 3, in this case at upper arm outboard pivot 19, through directing rollers 84*a* and past directing roller 84 to suitable means of control in center section 1. Auxiliary arm hold-down rigging line 83 is led from a termination point 27*b* in upper arm inner segment 11 under tension directing pulley 32, in this case concentric with lower arm inboard pivot 20, and over directing roller 85 to suitable means of control in center section 1. A simple physical restraint against rotation of inner arm segment 11 below its orientation in the laterally extended position of float 3 is illustrated by stop 86, attached to the underside of inner arm segment 11 and protruding therefrom into appropriate recessed spaces in the superstructure of center section 1 to rest against a lip structure (not shown).

Pistons 80 and 81 are extended to their maximum length when float 3 is in its laterally extended position, piston 80 being retracted to its minimum length when float 3 is moved upwardly and inwardly to its most raised position and piston 81 being retracted to its minimum length when float 3 is moved downwardly and inwardly to its most lowered position. Auxiliary float control rigging line 82 can be used in the shortening of either float arm 9 or float arm 10 when the hydraulic pressure in either piston 80 or 81 is released to allow the piston to return to a more retracted length, in lieu of positive hydraulic action in retracting the piston, and is, in fact, unnecessary if positive action is applied to effect the retraction of such a hydraulic piston or other suitable mechanically extendible members used in its stead. Auxiliary arm hold-down rigging line 83 is used to restrain upper arm inner segment 11 against upward rotation about inboard pivot 16 and must be relaxed to permit completion of upward rotation of the upper arm 9 in the movement of float 3 to its most raised position. If physical restraints are introduced to prohibit or resist rotation around internal pivot 17 of upper arm inner segment 11 and hydraulic piston 80 away from a substantially collinear orientation, such means comprising releasable locking means or springs or other suitable resilient means arranged to counteract rotation around pivot 17, for example, auxiliary hold-down rigging line 83 could be eliminated along with physical restraint, stop 86, as well. Other float arm assemblies employing hydraulic pistons or other mechanically extendible members in variations on the examples given in FIGS. 23 and 24 could readily be devised, but these examples illustrate the essential uses of such means in float arm assemblies displaceable to positions indicated in FIGS. 2 and 3.

Figure 25:
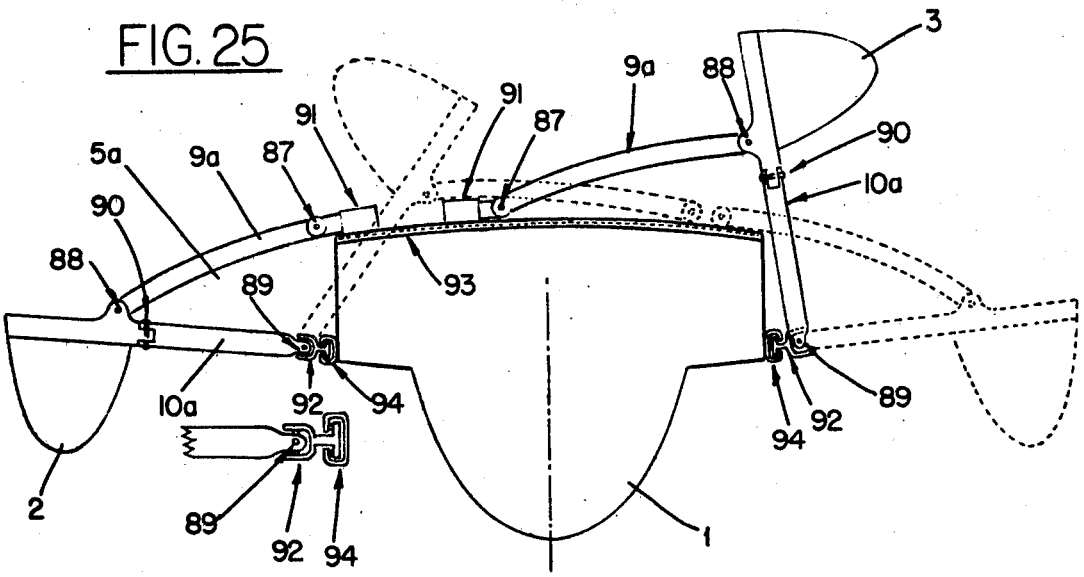
FIG. 25 is a cross-sectional view of a trimaran according to the invention with float arms pivotally and displaceably connected along tracks to the center section and illustrates the raising of the floats by movement of the pivot connections on the tracks.

FIG. 25 is a cross-sectional view of a trimaran according to the invention with float arm assemblies 4*a* and 5*a* comprising upper and lower arms 9*a* and 10*a*, pivotally connected at both inboard and outboard ends between center section 1 and floats 2 and 3, the inboard ends being slidingly movable on tracks 93 and 94 affixed to center section 1, the movement of upper arms 9*a* along tracks 93 acting to decrease the effective distance between floats 2 and 3 and the center section 1, thereby displacing floats 2 and 3 upwardly and inwardly to raised positions, and the movement of lower arms 10*a* along tracks 94 acting to decrease the effective distance between floats 2 and 3 and the center section, thereby displacing floats 2 and 3 downwardly and inwardly to lowered positions relative to their laterally extended positions.

Figure 26:
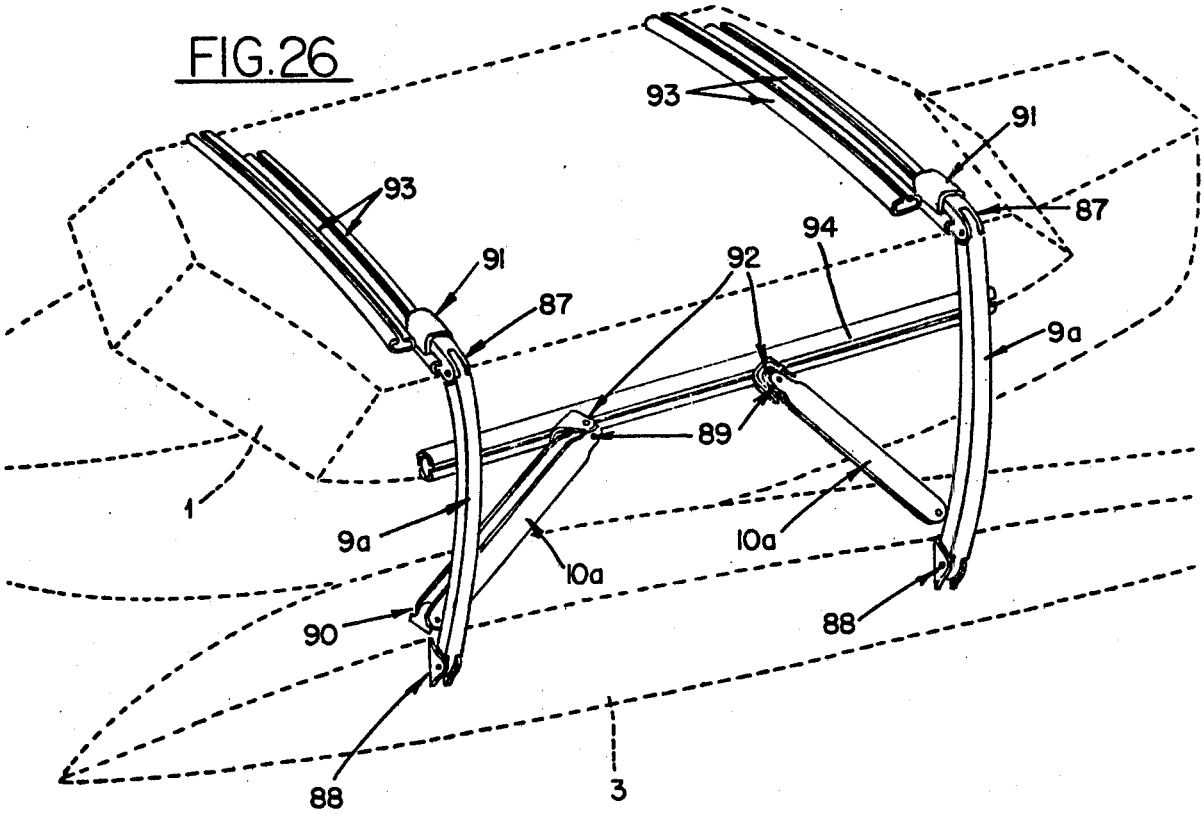
FIG. 26 is a perspective view of the port float and part of the center section for the same embodiment of the invention shown in FIG. 25, here illustrating the float in its lowered position and the corresponding displacement of the float arms on the tracks.

FIG. 26 is a perspective view of this same embodiment of float pivot connection means showing the superstructure of center section 1 in outline, tracks 93 and 94 mounted thereon, upper and lower float arms 9*a* and 10*a* connected between sliding pivot means 91 and 92, respectively, and port float 3 with pivots 87 and 89, respectively, at their inboard ends and pivots 88 and 90, respectively, at their outboard ends.

FIG. 25 shows port float 3 in a raised position, upwardly and inwardly moved from its laterally extended position. FIG. 26 shows port float 3 in a lowered position.

Referring now to either FIG. 25 or FIG. 26, upper arms 9*a* are connected to the respective associated floats 2 and 3 at outboard pivots 88 and to sliding pivot connections 91 at inboard pivots 87, the sliding pivot connections 91 being movable in tracks 93 mounted substantially transversely atop the center section 1. The axes of upper arm pivots 87 and 88 are generally parallel to the longitudinal axis of the vessel. Lower arms 10*a* are connected to the respective associated floats 2 and 3 at outboard pivots 90 and to sliding pivot connections 92 at inboard pivots 89, the sliding pivot connections 92 being movable in tracks 94 mounted in a substantially longitudinal fore and aft direction on the sides of center section 1. The axes of outboard lower arm pivots are generally vertical when associated floats 2 and 3 are in their laterally extended positions. Pivots 89 each comprise a universal joint mechanism with one axis remaining essentially parallel to the longitudinal axis of the vessel when the associated float 2 or 3 is moved upwardly and inwardly above the center section 1 and with a second axis changing from a substantially vertical orientation as sliding pivot connection 92 is moved along track 94 away from its initial position, wherein lower arm 10*a* is in a substantially transverse orientation relative to the vessel's longitudinal axis, toward an oblique orientation in a generally fore and aft vertical plane relative to the vessel's longitudinal axis as the associated float 2 or 3 is moved downwardly and inwardly, with rotation of the universal joint at pivot 89 around an axis perpendicular to track 94 at the float arm 10*a* moves toward an oblique orientation in a generally vertical fore and aft plane relative to the vessel's longitudinal axis.

Referring to FIG. 26 it can be seen that upper arm tracks 93 are mounted side-by-side in pairs fore and aft, slightly obliquely to a vertical transverse axis so that upper arms 9*a* can cross as floats 2 and 3 are raised and that float arm assemblies 5*a* are separated fore and aft at sufficient distance relative to the length of lower arms 10*a* so that fore and aft lower arm sliding pivot connections 92 can share the same tracks 94 for each associated float 2 or 3.

In an alternate embodiment of a multihull vessel with upper and lower arms 9*a* and 10*a* slidingly movable in tracks to effectively decrease the separation of floats 2 and 3 from center section 1 for raising of floats relative to their laterally extended positions by such movement of upper arms 9*a* or for lowering of floats relative to their laterally extended positions by such movement of lower arms 10*a*, certain variations in the placement of tracks are possible. In particular, tracks 93 for upper arms 9*a* could be arranged in a fore and aft direction atop or aside the superstructure of center section 1 or could be located with fore and aft orientation on floats 2 and 3 outboard the pivot connections for lower arms 10*a*. In like fashion, tracks 94 for lower arms 10*a* could be moved to locations beneath the superstructure of center section 1 or to locations on floats 2 and 3.

It will be noted that with any such embodiments of the invention employing sliding pivot connection means between center section 1 and floats 2 and 3 internal pivots in upper and lower float arms 9*a* and 10*a* would not be required to achieve the required raising and lowering of the floats. Without such internal pivots the need for rigging or other float height control rigging internal to float arm assemblies 4*a* and 5*a* would not be required either and suitable control means can be attached directly to the sliding pivot connections 91 and 92 to effect such float movement.

Figure 27:
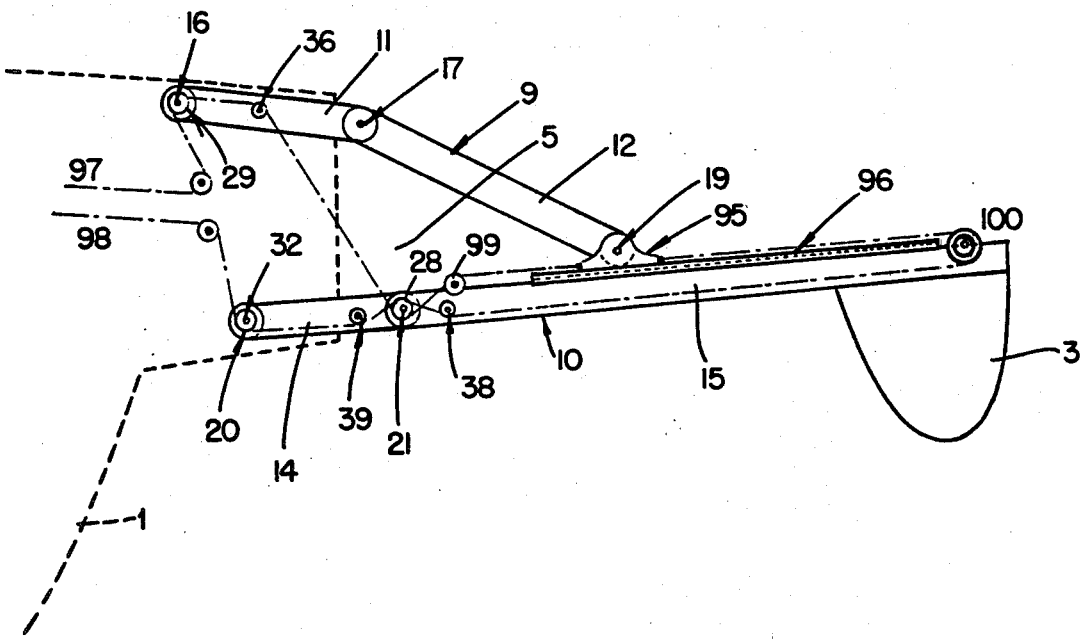
FIG. 27 is a cross-sectional view of one float arm assembly with a pivot at the other end of the upper arm displaceably connected to the lower arm along a track fixed thereupon.

FIG. 27 is a cross-sectional view of a trimaran according to the invention showing one float arm assembly 5 having upper and lower float arms 9 and 10 pivotally connected between the center section 1 and float 3, the upper arm means being pivotally connected at its outer end, pivot 19, to sliding pivot means 95, pivot means 95 being slidingly affixed to and movable in track 96, track 96 being mounted on lower arm 10.

Upper arms 9 and lower arms 10 are internally jointed at internal pivots 17 and 21, these pivots serving the same function as intermediate pivots 17 and 21 in FIGS. 2 and 3 for raising and lowering floats 2 and 3 relative to a laterally extended position. Comparing FIG. 27 with any of FIGS. 1 through 9, it can be seen that an outer internal pivot 18 in upper arm 9 has been eliminated in FIG. 27 with the function of rotation of upper arm segments 12 and 13 around pivots 18 in FIGS. 1 through 9 to permit upward movement of float 3 being replaced by sliding displacement of sliding pivot means 95 in FIG. 27.

Internal pivots 17 and 21 are principally involved in lowering of float 3 below its laterally extended position and are, in fact, not needed for raising float 3 above the laterally extended position. Float lowering rigging line 97 and float raising rigging line 98 are led, respectively, from the inboard side of sliding pivot means 95 via tension directing devices 99, 21, 36 and 16 and from the outboard side of sliding pivot means 95 via tension directing devices 100, 38, 21, 39 and 32 to suitable means in center section 1 for controlling their length and are shortened, respectively, to move pivot 19 toward center section 1, thereby raising float 3 above its laterally extended position, and to move pivot 19 away from center section 1, thereby lowering float 3 back to its laterally extended position. Further shortening of rigging line 97 after sliding pivot means 95 has reached its inboardmost limit on track 96 will act to displace lower arm internal pivot 21 upwardly, thereby decreasing the effective length of lower float arm 10 to lower float 3 below its laterally extended position.

Except for the fact that only one float arm in each float arm assembly 5 is directly connected to float 3 and that engineering design of sliding pivot means 95 may present greater problems in several areas than the design of an internal pivot 18, the embodiment of a pivotally connected float arm assembly shown in FIG. 27 can have all the advantages of the embodiment of FIGS. 7 or 8 and achieve all the desired float positions and float arm adjustability, including resiliency of float arm assemblies 4 and 5 against impact forces on floats 2 and 3, with the placement of tension directing devices 36, 38, 39 and 99 to achieve the required balance of forces at each internal pivot 17 and 21 for each desired orientation of float arm segments 11, 12, 14 and 15 presenting perhaps less of a problem than the placement of auxiliary tension directing pulleys in the embodiment of FIG. 7 or FIG. 8.

Figure 28:
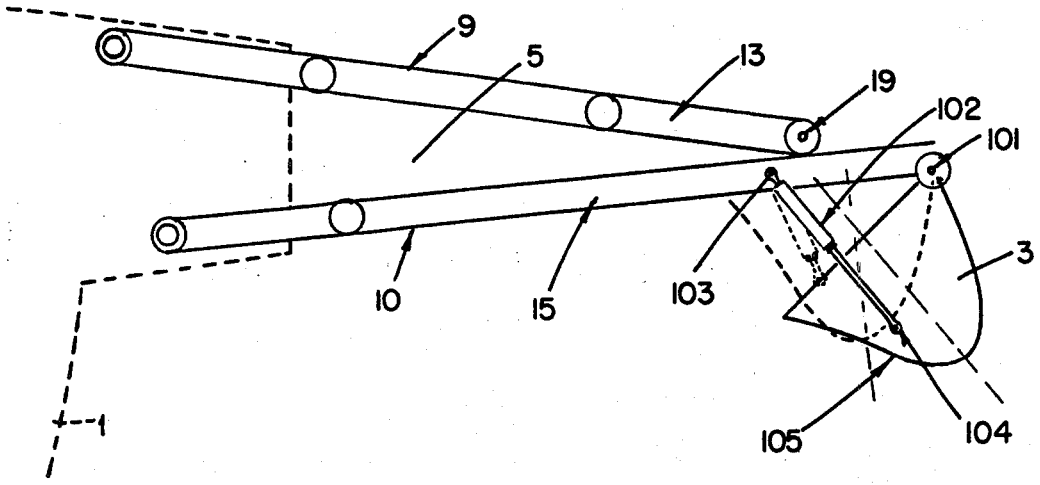
FIG. 28 is a cross-sectional view of a float arm assembly with the float connected pivotally along the outer end of the lower arm and rotatable around a longitudinal axis to bring a hydroplaning surface into engagement with the water.

FIG. 28 is a cross-sectional view of a trimaran according to the invention showing one float arm assembly 5 having upper and lower float arms 9 and 10 pivotally connected between the center section 1 and float 3, the float arms 9 and 10 being pivotally connected internally and to the center section as in previous drawings such as FIG. 1. Float 3 is pivotally connected to outer segment 15 of lower float arm 10 at its outer end by pivot 101 and by hydraulic piston 102 or other suitable mechanically extendible member inboard of pivot 101 between points 103 and 104 within float arm segment 15 and float 3, respectively. Actuation of piston 102 will cause rotation of float 3 downwardly and outwardly about a longitudinal axis through pivot 101 to bring hydroplaning surface 105, comprising or attached to the inboard side of float 3, into engaged position. Additional lowering of float 3 by partially downward rotation of upper float arm 9 may be performed as described for any of the heretofore presented embodiments of float arm assembly 5 in order to lift center section 1 in the water relative to float 3 and planing surface 105.

Figure 29:
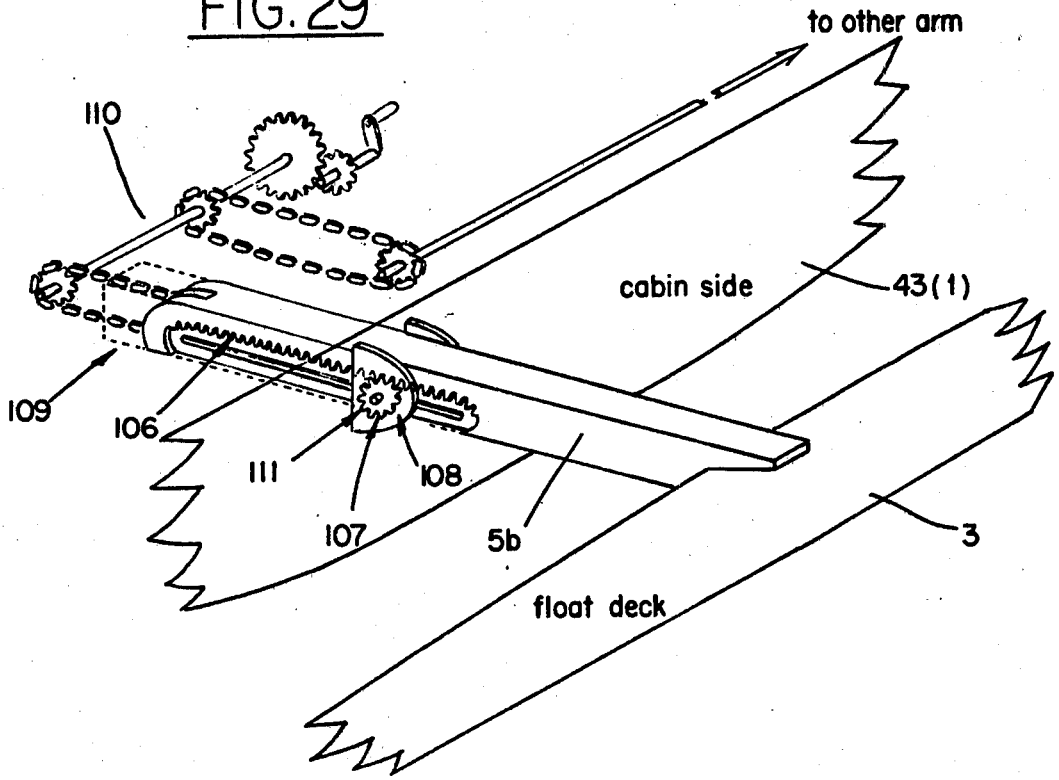
FIG. 29 is a perspective view of a float arm structure with rack and pinion means for longitudinally extending the float arm from a recessed position in the center section to a rotatable position external to the center section.

FIG. 29 is a perspective, somewhat schematic, partial view of a trimaran according to the present invention, illustrating a float arm assembly 5*b* comprising a single float arm 9*b*, capable of being used to accomplish the basic objectives of the invention. Part of the side surface of center section superstructure 43 and part of the top surface of float 3 are shown in the drawing along with rack and pinion means and control means for moving the float arm.

Rack and pinion means comprising rack gears 106 affixed on one or both sides of arm 9*b* and pinion gears 107 rotatably mounted on brackets 108 affixed to superstructure 43 is used to move the float arm 9*b* longitudinally in recessed guide 109 between a position maximally retracted within center section 1 and a position maximally extended and spaced from the center section. Control means comprising chain and sprocket assembly 110 and connected to a gear, not shown and contained in this embodiment within float arm 9*b*, on common axle 111 with pinion gears 107 passing through float arm 9*b* is used to turn pinion gears 107.

At its most extended position float arm 9*b* is located completely external to guide 109 and is free to rotate upwardly or downwardly around the axle 111 through pinion gears 107 and the sprocket gear located internal to arm 9*b*.

Once rotated to a vertical orientation relative to the upright vessel, either upwardly or downwardly, float arm 9*b* can be moved longitudinally again by rotation of pinion gear 107 to raise or lower float 3, decreasing its separation from center section 1 in either instance.

No self-contained devices are provided in FIG. 29 capable of affecting the upward or downward rotation of float arm 9*b*. External means such as already described, employing elements of standing rigging could be used for lifting the floats above their laterally extended position. Manual operation of arms 9*b* could be performed by the crew after capsize recovery to return the floats to their laterally extended position when little or no buoyant force is being applied to the associated float 3 (in this case assumed to be located to leeward) and when gravity cannot be exploited to perform that operation. Otherwise, force would have to be supplied by other external means to lower float 3.

It is noted that there is no requirement for the axle 111 of pinion gears 107 to pass through float arm 9, the axle being accommodated by a longitudinal slot in the arm affecting the structural integrity of the arm structure, as the chain and sprocket actuation means could be located entirely external to float arm **9*b***.

Actuating means other than rack and pinion arrangements could be employed for the longitudinal displacement of the float arm. A particular embodiment with hydraulic pistons located wholly within arm **9*b* external to axle 111 comprising its point of connection to the center section would simplify the design of control means, replacing chain and sprocket assembly 110. Float height adjustment means in place and at least partially ready to be used could be contained within arm 9*b*** to be exposed when the arm is extended from the center section. A particular example of such means would comprise hydraulic pistons recessed within channels along the float arm, pivotally connected to the arm at their outer ends so that they can swing into engagement at their inner ends with means connected to the center section when the arms are fully extended.

Figure 30:
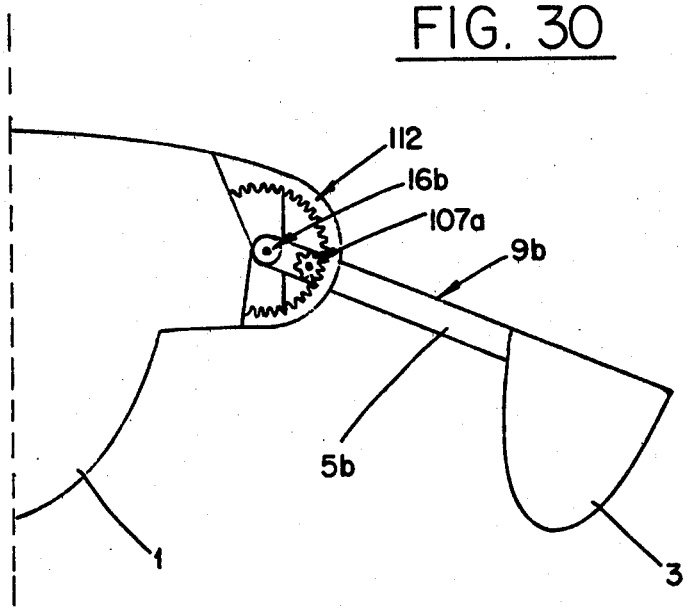
FIG. 30 is a cross-sectional view of one float arm structure rotatable at its inner end, pivotally connected to the center section, actuated by rotation of a pinion gear connected to the float arm structure in a sector gear connected to the center section.

FIG. 30 is a cross-sectional view of a float arm assembly **5*b* comprising a single arm 9*b* pivotally connected to the center section 1 at pivot 16*b* with a pinion gear 107*a* attached on arm 9*b* and engaging a sector gear 112 for traveling along its circumference on teeth on the inner side of the gear circumference, sector gear 112 being affixed to center section 1 and oriented in a vertical plane perpendicular to the longitudinal axis of the vessel. Appropriate means, not shown, are employed to turn pinion gear 107*b*, rotating float arm 9*b* between positions wherein float 3** is fully lowered, laterally extended or fully raised.

In an alternate embodiment, sector gear 112 could be affixed to float arm **9*b* and pinion gear 107*b* attached to center section 1 and in either embodiment apparatus having the function of FIG. 30 could be combined with apparatus having the function of FIG. 29**.

Any subset of physical features and principles herein described or mentioned which may be reasonably used in combination to achieve operational capabilities expressed, implied or readily apparent in the use thereof may be considered to be an embodiment of the present invention insofar as there can be shown to be any degree of originality in the function or application of said features and principles separately or in conjunction with other features of such subset.

What I claim and desire to secure by Letters Patent is:

1. A multihull vessel comprising:

a center section, a pair of floats disposed on opposite sides of the center section and spaced therefrom, pivot connection means pivotally connecting each float to the center section for movement between:

a first position laterally extended from the center section to render the vessel stable in an upright condition, and a second position located beneath the center section when the vessel is fully capsized to render the vessel unstable by locating the center of buoyancy of the capsized vessel below the center of gravity to promote righting of the capsized vessel;

power means for moving said pivot connection means between said first and second positions, the pivot connection means comprising a float arm assembly on each side of the vessel interconnecting the center section and a respective float, each float arm assembly including first and second arm means, said first and second arm means being pivotably attached to said center section at vertically spaced locations, said first and second arm means each including means for progressively changing the effective length of said first and second arm means as said float moves between said first and second positions.

2. A vessel according to claim 1, wherein said first and second arm means each comprises a fluid-actuated extensible and retractible ram.

3. A vessel according to claim 1, wherein one of said arm means comprises a plurality of arm segments interconnected by a horizontal pivot.

4. A vessel according to claim 3, wherein said power means is operably connected to said one arm means to relatively rotate said segments thereof and thereby change the effective length of said arm.

5. A vessel according to claim 3, wherein either of said arm means comprises a fluid-actuated extensible and retractable arm.

6. A vessel according to claim 1, wherein each float is movable to a third position located beneath the center section when the vessel is upright, said means for progressively changing the effective length comprises means for progressively changing the effective length of the respective said arm means as said float moves between said first and third positions.

7. A vessel according to claim 1, wherein said power means comprises a mechanically extensible and retractible member connected to at least one of said first and second arm means.

8. A vessel according to claim 7, wherein said member comprises a fluid-actuated motor.

9. A vessel according to claim 1, wherein said power means comprises at least one mechanically extensible and retractible member connected to at least one of said first and second arm means.

10. A vessel according to claim 9, wherein said mechanically extensible and retractible member comprises a fluid-actuated motor.

11. A vessel according to claim 1, wherein said pivot connection means pivotally connects each float to the center section for movement between said first and second positions and further between a third position located downwardly and inwardly from said first position when the vessel is in an upright condition, or upwardly and inwardly from said first position when the vessel is in an inverted condition, to reduce the beam of the vessel. --

* * * * *